US010323837B2

(12) United States Patent
Hierzer

(10) Patent No.: US 10,323,837 B2
(45) Date of Patent: Jun. 18, 2019

(54) LIGHTING SYSTEM

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 0 days.

(21) Appl. No.: 15/844,028

(22) Filed: Dec. 15, 2017

(65) Prior Publication Data

US 2018/0172257 A1 Jun. 21, 2018

(30) Foreign Application Priority Data

Dec. 15, 2016 (DE) ..... 10 2016 225 199

(51) Int. Cl.
*F21S 4/00* (2016.01)
*F21V 23/06* (2006.01)
(Continued)

(52) U.S. Cl.
CPC ..... *F21V 23/06* (2013.01); *F21S 2/005* (2013.01); *F21S 4/28* (2016.01); *F21S 8/02* (2013.01); *F21V 5/04* (2013.01); *F21V 5/043* (2013.01); *F21V 19/0035* (2013.01); *F21V 21/005* (2013.01); *F21V 21/096* (2013.01); *F21V 21/35* (2013.01); *F21V 23/023* (2013.01); *F21V 23/0435* (2013.01); *H01R 25/145* (2013.01); *F21Y 2103/10* (2016.08); *F21Y 2115/10* (2016.08)

(58) Field of Classification Search
CPC ..... F21Y 2103/00; F21S 4/003; F21V 21/005
USPC ..... 362/219
See application file for complete search history.

(56) References Cited

U.S. PATENT DOCUMENTS 3,722,318 A 3/1973 Asou et al.
7,744,386 B1 * 6/2010 Speidel ..... H01R 25/145 439/118
(Continued)

FOREIGN PATENT DOCUMENTS

DE 2113716 B1 10/1971
DE 10025646 A1 11/2001
(Continued)

OTHER PUBLICATIONS

Search Report for EP Patent Application No. 17207328 dated Jan. 24, 2018.
(Continued)

*Primary Examiner* — Ahshik Kim
(74) *Attorney, Agent, or Firm* — Millen, White, Zelano & Branigan, P.C.; William Nixon

(57) ABSTRACT

A lighting system has at least one channel for receiving at least one light unit that can be inserted into the channel, and at least one connector that can be inserted into the channel. The channel has, in an inner region thereof, a busbar for supplying the light unit, which can be electrically coupled to the busbar, with power. The connector is designed to electrically couple busbar portions of the busbar to one another. Furthermore, the connector is designed to be mechanically coupled to portions of the channel. The channel and the connector are further designed such that, when inserted in the channel, the light unit can be arranged so as to overlap the connector, inserted into the channel in order to couple the busbar portions, within the channel.

20 Claims, 10 Drawing Sheets

(51) Int. Cl.

| | |
|---|---|
| ***F21S 2/00*** | (2016.01) |
| ***F21S 8/02*** | (2006.01) |
| ***F21V 21/005*** | (2006.01) |
| ***F21V 21/35*** | (2006.01) |
| ***F21V 5/04*** | (2006.01) |
| ***F21S 4/28*** | (2016.01) |
| ***F21V 19/00*** | (2006.01) |
| ***F21V 21/096*** | (2006.01) |
| ***F21V 23/02*** | (2006.01) |
| ***F21V 23/04*** | (2006.01) |
| ***H01R 25/14*** | (2006.01) |
| *F21Y 103/10* | (2016.01) |
| *F21Y 115/10* | (2016.01) |

(56) References Cited

U.S. PATENT DOCUMENTS

| | | | | |
|---|---|---|---|---|
| 9,188,324 | B2 | 11/2015 | Jelinek et al. | |
| 9,958,114 | B2 | 5/2018 | Park | |
| 2007/0064428 | A1* | 3/2007 | Beauchamp | A47F 3/001 362/294 |
| 2008/0315132 | A1* | 12/2008 | Platsch | F26B 3/283 250/504 R |
| 2013/0272012 | A1* | 10/2013 | Thibodeau | F21V 15/01 362/546 |
| 2014/0362574 | A1 | 12/2014 | Barrett | |
| 2015/0029731 | A1 | 1/2015 | Jelinek et al. | |
| 2015/0138771 | A1 | 5/2015 | Jelinek et al. | |
| 2015/0226384 | A1 | 8/2015 | Park | |
| 2016/0195250 | A1* | 7/2016 | Park | F21S 8/038 362/219 |

FOREIGN PATENT DOCUMENTS

| | | | |
|---|---|---|---|
| DE | 102010043140 | A1 | 5/2012 |
| DE | 202015105855 | U1 | 2/2017 |
| EP | 1433997 | A2 | 6/2004 |
| EP | 2113716 | A1 | 11/2009 |
| EP | 2650607 | A1 | 10/2013 |
| WO | 14195801 | A2 | 12/2014 |

OTHER PUBLICATIONS

English Abstract of DE202015105855, Publication Date: Feb. 8, 2017.

English Abstract of DE10025646, Publication Date: Nov. 29, 2001.

English Abstract of DE102010043140, Publication Date: May 3, 2012.

English Abstract of EP-1433997, Publication Date: Jun. 30, 2004.

Office Action in corresponding AT application 1B A 50030/2017-1 dated Apr. 8, 2019 (pp. 1-4).

* cited by examiner

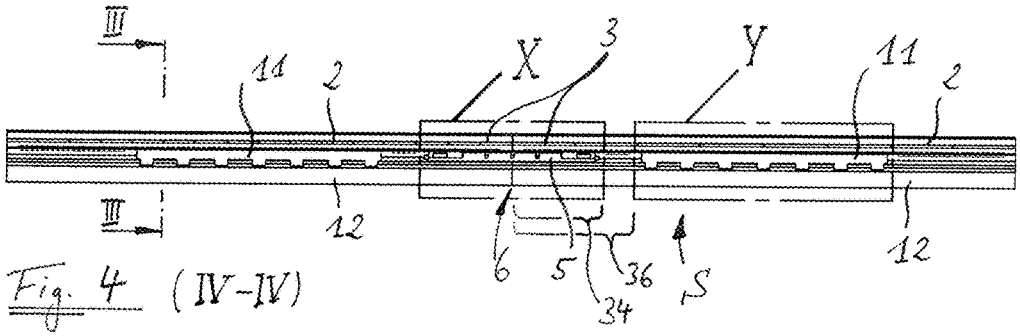
Fig. 4 (IV-IV)
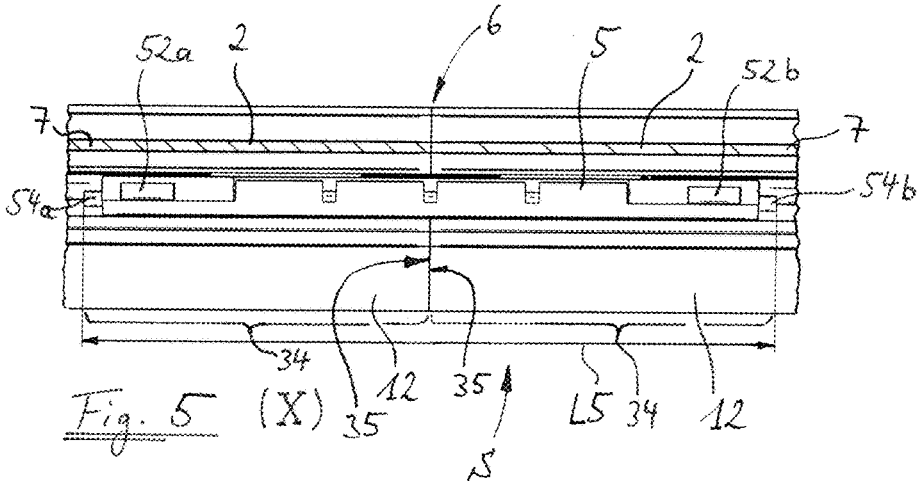
Fig. 5 (X)
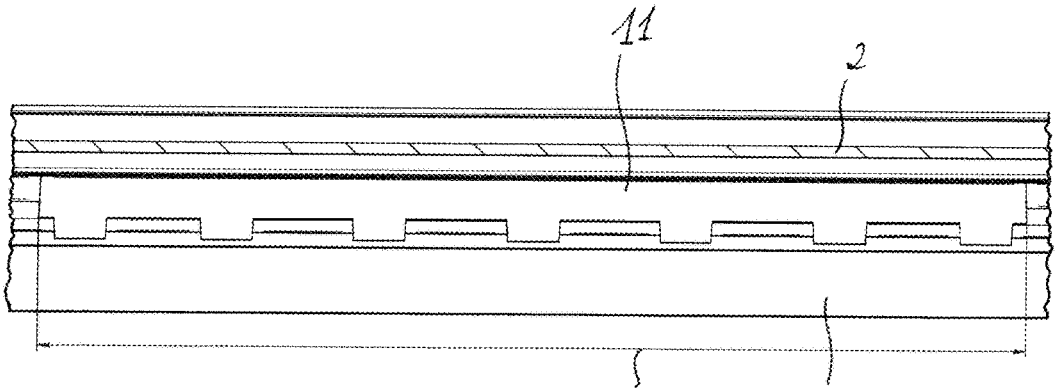
Fig. 6 (Y)

(IX - IX)

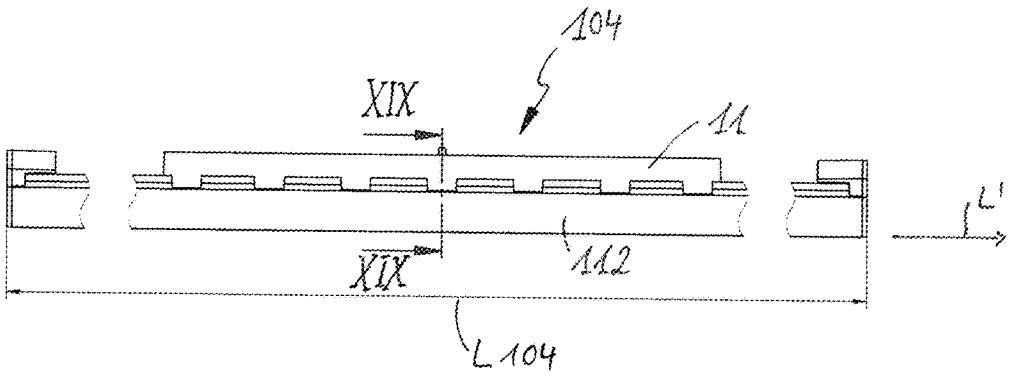
Fig. 18
Fig. 17
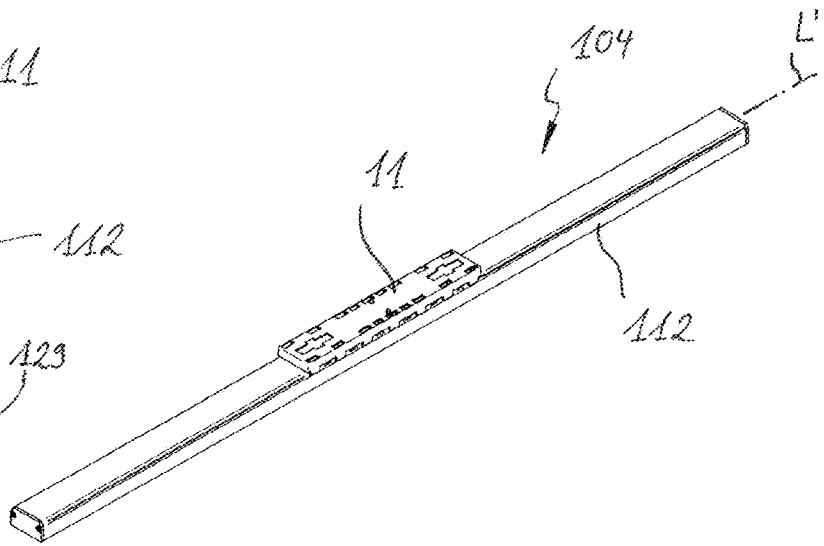
Fig. 20
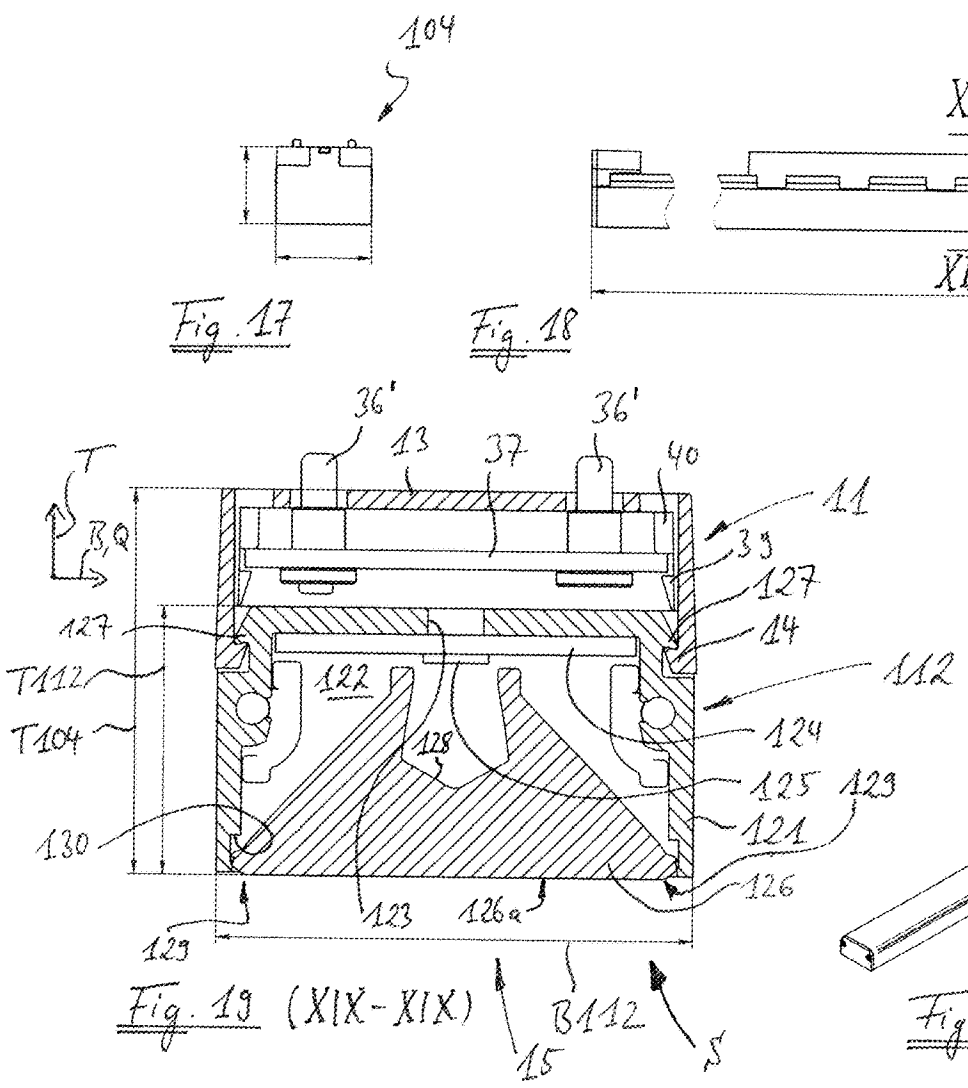
Fig. 19 (XIX-XIX)

204
11
242
L204
L'
XXIII
XXIII

204

36'
13
33
224
11
227
14
242
221
226
230
229
B242
225
228
222
226a
229
230
227
14
T204
T242
T
B,Q
36'
13
14
221
36'
223
222

Fig. 23 (XXIII-XXIII)

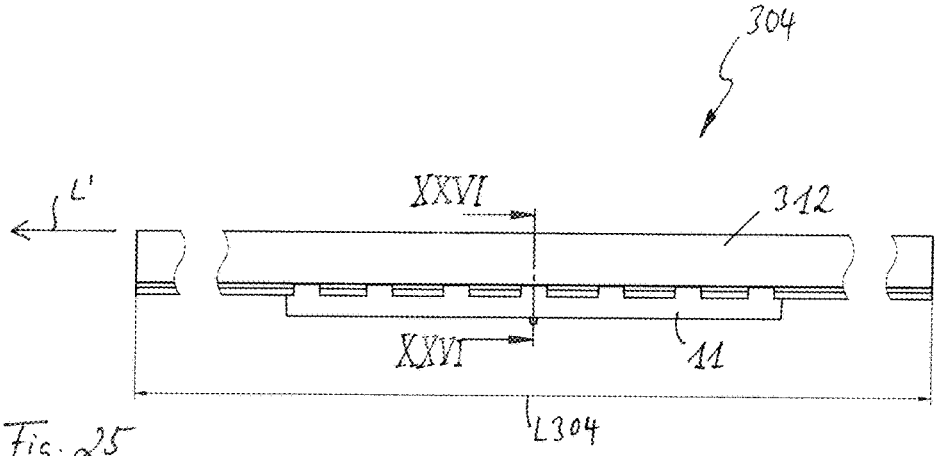
Fig. 25
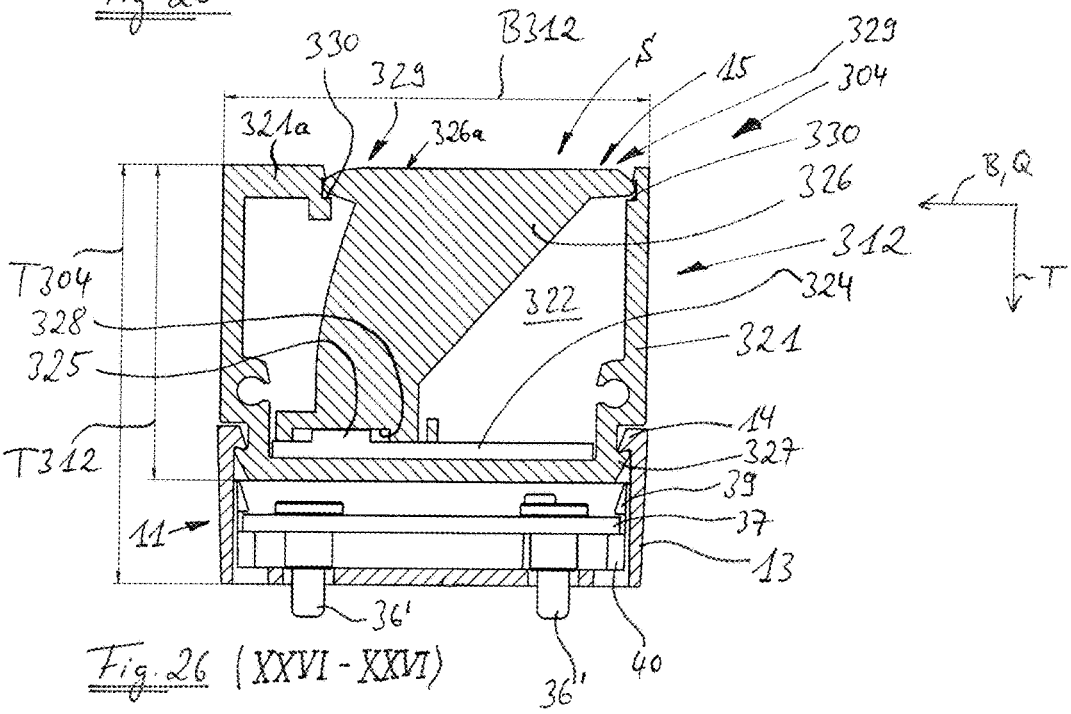
Fig. 26 (XXVI - XXVI)
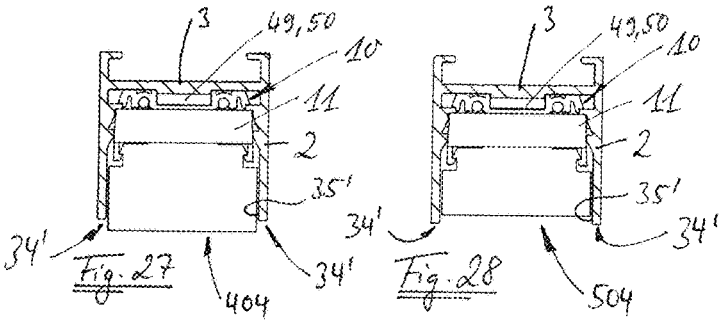
Fig. 27 Fig. 28

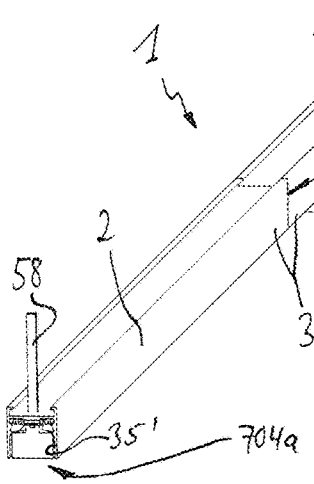
Fig. 36
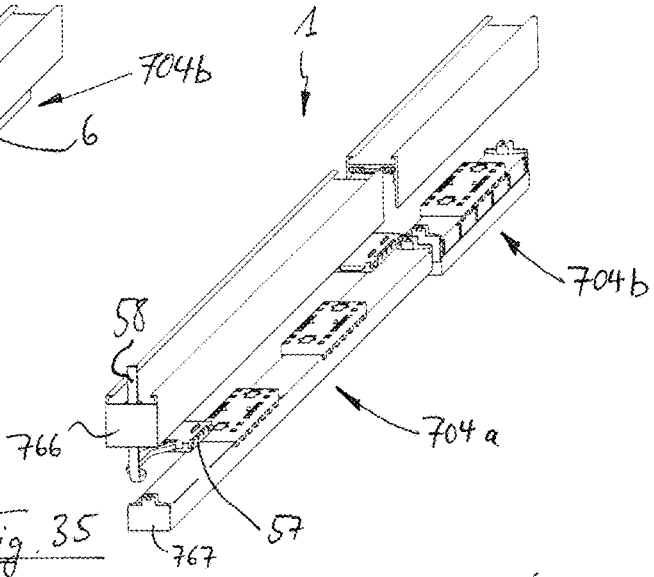
Fig. 35
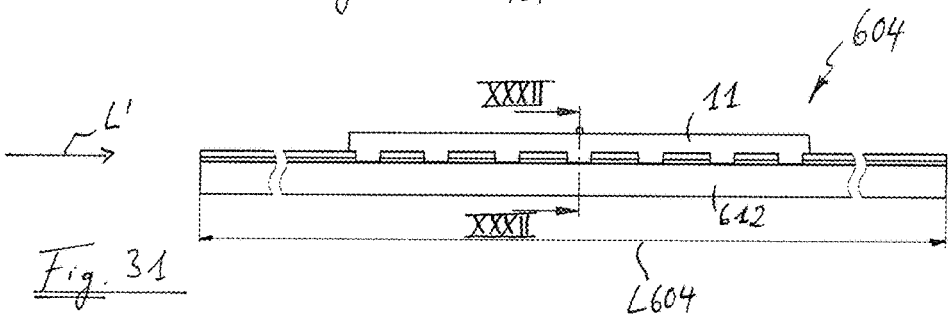
Fig. 31
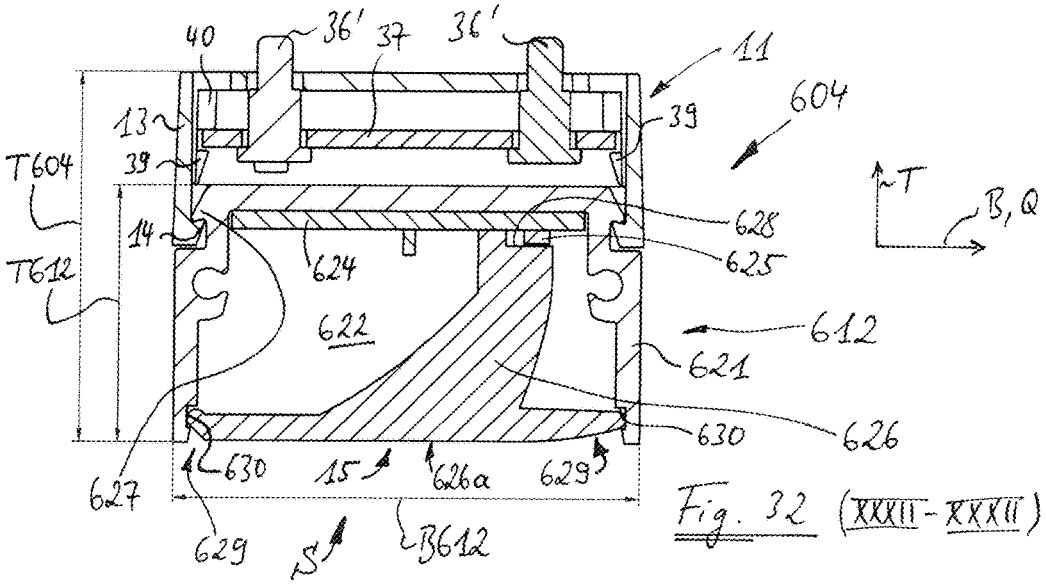
Fig. 32 (XXXII - XXXII)

1
767
735
L'
11
704b
712b
2
735
767
767
735
5
11
712a
704a
2
11
57
767
735
58
Z
766
7''
(c)
7'''
(a)
9'''
7''''
(b)

10
64b
64a
57
59
2
58
765
766

LIGHTING SYSTEM

FIELD OF THE INVENTION

The present invention relates to a lighting system.

TECHNICAL BACKGROUND

A lighting system which comprises a channel and lighting inserts which can be inserted into the channel is known to the applicant. In said system, a busbar is integrated into the channel. In order to connect the busbars of consecutive portions of the channel, a busbar connector is provided. In the system known to the applicant, the dimensioning takes into consideration the space requirement for controlling the lighting inserts in a wired manner via control lines by means of what is known as the DALI system.

However, in the case of this known solution, it is not possible to implement continuous, and in particular long, aesthetically pleasing strip lights at the same time as a low installation depth or "system height" and also a low installation width or "system width".

This is a state of affairs for which there is room for improvement.

FIELD OF THE INVENTION

In this context, an idea of the invention is to provide a lighting system that can be constructed so as to be particularly slim and makes it possible to produce continuous, aesthetically pleasing strip lights having a low installation depth and a low installation width.

Thus, a proposal is made for a lighting system comprising at least one channel for receiving at least one light unit that can be inserted into the channel, and further comprising at least one connector that can be inserted into the channel, the channel comprising, in an inner region thereof, a busbar for supplying the light unit, which can be electrically coupled to the busbar, with power. In the lighting system according to the invention, the connector is designed to electrically couple busbar portions of the busbar to one another. Furthermore, the connector is designed to be mechanically coupled to portions of the channel. According to the invention, the channel and the connector are further designed such that, when inserted in the channel, the light unit can be arranged so as to overlap the connector, inserted into the channel in order to couple the busbar portions, within the channel.

The concept of the invention is that of making it possible to produce continuous strip lights, even long ones, by means of light units that can be inserted into the channel, by the channel, the connector and the light unit being designed, as components of the lighting system, such that, in an operational state, i.e. when the light unit and the connector have been inserted into the channel, the light unit and the connector can overlap one another within the channel. It is thus also possible to achieve a low "system height" and "system width", in particular low widths and heights of the channel. At the same time, the proposed lighting system having the busbar provided in the inner region of the channel allows for versatile, multi-faceted lighting solutions; in particular, the busbar can be used to supply different kinds of lighting inserts that can be inserted into the channel, with power.

In one embodiment, the lighting system further comprises the at least one light unit. In this case, the channel, the light unit and the connector are designed such that, when inserted and overlapping the connector, the light unit can be received in the channel completely or at least substantially completely. A lighting system of this kind is particularly slim and discreet. A light unit that is completely received in the channel can be particularly aesthetically pleasing.

In a development of the invention, the light unit and the channel may be designed such that, when inserted, the light unit is arranged in the opening in the channel so as to be flush therewith. Alternatively, in a development, the light unit and the channel may be designed such that, when inserted, the light unit is offset in the inner region of the channel, in relation to the opening in the channel. Whether flush or offset, the light unit can therefore be completely received in the channel. It is possible for both the flush arrangement and the offset arrangement to be aesthetically pleasing.

In a further embodiment of the invention, the lighting system further comprises the at least one light unit, with the channel, the light unit and the connector being designed such that, when inserted and overlapping the connector, the light unit protrudes out of the opening in the channel. However, it is noted that, even in this case, when inserted the light unit can overlap the connector, likewise inserted in the channel, within the channel. The light unit that protrudes out of the opening in the channel makes it possible to achieve a different, aesthetic effect.

In particular, whether flush with the opening in the channel, offset in relation to the opening in the channel or protruding out of the opening in the channel, the light unit makes it possible to produce continuous strip lights, in particular not having poorly lit junction points.

According to a further embodiment of the invention, the channel and the light unit are designed such that, when inserted, the light unit substantially fills the channel in the transverse direction thereof, at least on a viewing side of said light unit. By means of a slim lighting system having a relatively low installation width, an embodiment of this kind advantageously makes it possible to achieve effective lighting. In this embodiment, the available system width is advantageously used to house the light unit.

In a further embodiment, the lighting system comprises at least two of the light units, which can be each arranged so as to overlap the connector within the channel such that end portions of the light units that overlap the connector substantially directly adjoin one another on the end faces thereof and in particular conceal the connector at least in part, for example substantially completely. Thus, this embodiment makes it possible to produce aesthetic, continuous strip lights, avoid unlit points in the system, and advantageously conceal the connector behind the light units.

In a further embodiment, the light unit is designed as a linearly elongate unit. In this case, the light unit is in particular designed to form, together with at least one further linearly elongate light unit and when inserted in the channel, a continuous strip light during operation.

In another embodiment, the length of the light unit in a longitudinal direction thereof is at least ten times the width of the light unit, the width being taken to be in a direction which extends transversely to a depth direction of the channel when the light unit is inserted.

In particular, the length of the light unit may be at least 20 times, at least 40 times, at least 60 times or at least 80 times the width of the light unit.

In a further embodiment, light can be emitted, during operation, by the light unit in a light outlet region that extends over substantially the entire length of the light unit. Thus, the entire length of the light unit can be used for emitting light, and dark points on the strip light are avoided.

According to a further embodiment, the light unit can be coupled to the channel in order to hold said light unit. The light unit can thus be held in a defined manner for the attachment thereof. In particular, the light unit can be magnetically coupled to the channel. Magnetic coupling offers a large degree of flexibility in the arrangement of the light unit in the channel. Magnetically, the light unit can also be held in a reliable manner. An operator can easily establish and release the magnetic coupling, and without tools.

In particular, in one embodiment, the channel may be provided with at least one ferromagnetic element in order to allow the light unit to be magnetically coupled to the channel.

In one embodiment of the invention, the channel is designed having at least two portions, the portions of the channel meeting at a junction point and each having a busbar portion, the connector further allowing the busbar portions to be electrically coupled across the junction point. In this case, the connector can electrically couple in particular the busbar portions of straight channel portions to one another, which adjoin one another in a straight or angled manner. For this purpose, the connector may in particular comprise contact elements, each of which can be brought into contact with a conductor of one of the busbar portions in order to electrically couple the busbar portions.

In one embodiment, the portions of the channel are each formed having an extruded profile body, in particular having an extruded profile made of aluminium or an aluminium alloy.

In embodiments of the invention, the channel may be designed as a built-in channel for being built into a wall or a ceiling, as a mounting channel, in particular for being mounted on a wall or on a ceiling, or as a channel for being mounted in a suspended manner, in particular on a ceiling. As a built-in channel, the channel may in particular be designed to be built into a plasterboard ceiling or plasterboard wall so as to be preferably edgeless and/or flush.

In another development of the invention, the portions of the channel may be assembled to form a channel of any desired length, the busbar portions of adjoining portions of the channel being electrically coupled by a connector in each case. The lighting system may therefore comprise a plurality of connectors as required. The proposed lighting system thus makes it possible to produce lighting solutions for spaces of all different sizes.

Mechanically coupling the connector to the portions of the channel also allows portions of the channel adjoining at the junction point to be additionally mechanically aligned and guided with respect to one another. Additional elements for mechanical guidance are not therefore required. Advantageously, while requiring little space, the connector both allows the busbar portions to be electrically coupled, and mechanically guides the adjoining portions of the channel. This further contributes to the lighting system, having a low installation width and a low installation high, being slim.

In one embodiment of the invention, the light unit comprises a light provision and optics unit and at least one power supply unit. In this case, the power supply unit comprises contact devices, which allow the light unit to be electrically coupled to the busbar. Furthermore, in this embodiment, the power supply unit is electrically coupled to the light provision and optics unit. The power supply unit further comprises a housing element that is mechanically coupled to the light provision and optics unit. Thus, a standardisation of the power supply unit for different light units can advantageously be achieved, for example. For example, different kinds of light unit may comprise an identical power supply unit, but different light provision and optics units. Furthermore, light units of different lengths in the longitudinal direction thereof could, for example, advantageously have identical power supply units; in this case, a longer light unit may comprise a plurality of identical power supply units, while short light units could each comprise only one power supply unit of this kind. Mechanically coupling the power supply unit to the light provision and optics unit by means of the housing element of said power supply unit makes it possible for the two units to be reliably connected.

In one embodiment, the power supply unit is latched to the light provision and optics unit. In particular, for this purpose the housing element of the power supply unit may be provided with latching devices. The power supply unit can thus be easily and reliably connected to the light provision and optics unit. The power supply unit being connected to the light provision and optics unit by means of latching devices on the housing element of the power supply unit may also be cost-effective.

In a further embodiment of the invention, the housing element of the power supply unit projects, in a direction which extends in parallel with a depth direction of the channel when the light unit is inserted, substantially as far beyond the light provision and optics unit as a housing of the connector extends in a thickness direction of the connector. In this way, the space available in the channel, in particular in the inner region thereof, can be utilised particularly effectively, this at the same time allowing the light unit to overlap the connector.

In a further embodiment, when inserted in the channel, the light unit can be arranged so as to overlap the connector, inserted into the channel in order to couple the busbar portions, such that the light provision and optics unit overlaps the connector, whereas the power supply unit does not overlap the connector. This again allows the available space to be utilised effectively.

In one embodiment, the light unit, in particular the light output thereof, and for example the intensity thereof, can be switched and/or controlled wirelessly.

In another embodiment, the light unit can be switched and/or controlled wirelessly, the power supply unit comprising, for this purpose, a module by means of which control signals for switching and/or controlling the light output of the light provision and optics unit, in particular the intensity thereof, can be received wirelessly, the module preferably being received in the housing element of the power supply unit.

Wirelessly controlling the light unit or wirelessly switching the light unit allows the installation depth and the installation width of the lighting system to be advantageously kept to a minimum. The ability to switch and/or control the light unit wirelessly makes it possible to circumvent the space requirements that arise when control lines are used for controlling light units in a wired manner. Space-consuming contact devices or terminals for control lines, such as for what is known as the DALI system are dispensed with, and it is thus possible for both the power supply unit and the connector to be particularly slim.

In particular, the control signals for switching and/or controlling the light output of the light provision and optics unit may be radio signals.

In a further embodiment of the invention, the power supply unit is designed as a holding unit for the light unit, for holding the light unit in the channel. In this case, in particular, the power supply unit may contain magnets, for example permanent magnets, for mechanically coupling the light unit to the channel. Thus, the function of holding the light unit irrespective of the specific embodiment of the light provision and optics unit can be built into a standardisable power supply unit. The advantages of mechanical coupling to the channel have already been explained above. Magnetic coupling by means of permanent magnets can be implemented particularly easily.

In particular, the housing element of the power supply unit may additionally receive the magnets.

In one embodiment, the extension of the light unit in a direction which is in parallel with the depth direction of the channel when the light unit is inserted is smaller than or equal to the width of the light unit in a direction transverse to the depth direction of the channel. This may again contribute to a space-saving and aesthetic design of the lighting system.

According to a further embodiment, in a direction which extends transversely to the depth direction of the channel when the light unit is inserted, a width of the power supply unit is at least 80%, for example at least 90%, of a width of the light provision and optics unit. In particular, in a direction which extends transversely to the depth direction of the channel when the light unit is inserted, a width of the housing element of the power supply unit may be at least 80%, for example at least 90%, of a width of the light provision and optics unit. In this way, the space available in the inner region of the channel may be utilised even more effectively, and this again has an advantageous influence on the space requirement, in particular the installation depth, for example, of the lighting system.

In particular, the width of the housing element of the power supply unit may correspond substantially to the width of a connector housing of the connector.

According to a further embodiment, in a direction which extends in parallel with a depth direction of the channel when the light unit is inserted, the light provision and optics unit has a height of from approximately 13 mm to approximately 20 mm, for example approximately 14 mm or approximately 19 mm, for example 14.1 mm or 14.3 mm or 19 mm, and/or in a direction which extends transversely to the depth direction of the channel when the light unit is inserted, the light provision and optics unit has a width of from approximately 24 mm to approximately 28 mm, for example approximately 25 mm or approximately 27 mm, for example 25.4 mm or 27.2 mm, and/or the channel comprises, at least in a region in which the light provision and optics unit is housed when the light unit is inserted, has an inner width of from approximately 27.5 mm to approximately 28.5 mm, for example substantially 28 mm. A lighting system of this kind is particularly slim and space-saving.

According to a further embodiment, in a direction which extends in parallel with the depth direction of the channel when the light unit is inserted, the light unit has a height, as measured over housing parts of the light unit, of from approximately 19 mm to approximately 27 mm, for example approximately 20 mm or approximately 21 mm or approximately 25 mm, for example 20.3 mm or 20.5 mm or 25.2 mm, and/or the channel has a depth, available for receiving the light unit, of from approximately 19 mm to approximately 22 mm, for example approximately 20 mm or approximately 21 mm, for example approximately 20.5 mm.

According to a further embodiment, the light unit comprises a linearly elongate lens. The linearly elongate lens makes it possible in particular to ensure that, the desired light image, e.g. a light image that is as uniform as possible, over the length of the light unit and the desired light distribution are achieved along the light unit.

In a further embodiment, the light provision and optics unit comprises a housing component in which the lens and an LED circuit board are received. In this case, the housing component of the light provision and optics unit is mechanically coupled to the housing element of the power supply unit. In this way, the lens and the LED circuit board can be held securely by means of the housing component and thus also coupled to the power supply unit, for example. Furthermore, the lens, the LED circuit board and the housing component may together be preassembled to form a light provision and optics unit that is easy to handle, and only then be mechanically coupled to the power supply unit, for example. The LED circuit board and the lens can be protected by the housing component. Furthermore, in developments, the housing component may be transparent or opaque, depending on which aesthetic effect is intended to be achieved.

In a further embodiment of the invention, the lens has a cross section that is substantially constant in a longitudinal direction of the lens. In particular, the extension of the lens in a direction which is in parallel with the depth direction of the channel when the light unit is inserted is smaller than in a width direction of the lens transverse to the depth direction of the channel. It is relatively simple to produce a lens, according to this embodiment, having a substantially constant cross section. Advantageously, a lens which, according to this embodiment, has a width, transverse to the depth direction of that channel, that is larger than the height of said lens, in parallel with the depth direction of the channel, again contributes to a space-saving lighting system having a low installation depth.

According to a further embodiment, the connector comprises movable catches. The channel is provided, in the inner region, with longitudinal ribs, the catches of the connector being designed to engage behind the longitudinal ribs in order to latchingly couple the connector to the portions of the channel, and it being further possible for an operator to disengage the catches from the longitudinal ribs, in order to release the coupling, by actuating an actuation element or a plurality of actuation elements. Reliable mechanical coupling of the connector to the portions of the channel is possible, at the same time as low overall dimensions.

In embodiments of the invention, the at least one light unit, which can be arranged so as to overlap the connector within the channel may be designed in different ways, for example as a light unit for a diffused light unit for diffused lighting or a light unit for focused lighting. In this way, allowance can be made for many different kinds of lighting requirements.

Furthermore, in further embodiments of the lighting system, according to the invention the lighting system may comprise additional lighting inserts, it being possible to insert the additional lighting inserts into the channel and to electrically couple each of said inserts to the busbar in order to be supplied with power. An additional light unit of this kind may be designed, for example, as a spotlight, a pivotable spotlight, a suspended spotlight, a wallwasher, a linear arrangement of spotlights, or a linear lighting insert that radiates in a diffused manner. In a further embodiment, the additional light unit may be designed having a pendant lighting fixture.

The above embodiments and developments may, if meaningful, be combined as desired. Further possible embodiments, developments and implementations of the invention also include not explicitly mentioned combinations of features of the invention described above or below in relation to the embodiments. In particular, a person skilled in the art would also add individual aspects as improvements or additions to the particular basic form of the present invention.

BRIEF DESCRIPTION OF THE DRAWINGS

The invention will be described below in more detail on the basis of the embodiments indicated in the schematic figures of the drawings, in which:

FIG. 4 shows a longitudinal, central cross section IV-IV (see FIG. 3) of the lighting system according to FIG. 2, with some components not appearing in section.

FIG. 5 shows a detail X from FIG. 4;

FIG. 6 shows a detail Y from FIG. 4;

FIG. 17 is an end view of a light unit for the lighting system according to the second embodiment;

FIG. 18 is a side view of the light unit in FIG. 17;

FIG. 19 shows a cross section XIX-XIX (see FIG. 18) of the light unit in FIG. 17;

FIG. 20 is a perspective view of the light unit in FIG. 17, a first side of the light unit, which faces a busbar of the channel when the light unit is inserted in the channel, facing upwards;

FIG. 23 shows a cross section XXIII-XXIII (see FIG. 22) of the light unit in FIG. 21;

FIG. 25 is a side view of a light unit according to a fourth embodiment;

FIG. 26 shows a cross section XXVI-XXVI (see FIG. 25) of the light unit in FIG. 25;

FIG. 27 shows a transverse cross section of a lighting system according to a fifth embodiment when assembled;

FIG. 28 shows a transverse cross section of a lighting system according to a sixth embodiment when assembled;

FIG. 31 is a side view of a light unit according to a seventh embodiment;

FIG. 32 shows a cross section XXXII-XXXII (see FIG. 31) of the light unit in FIG. 31;

FIG. 35 is a further perspective, exploded view of the lighting system in FIG. 33; and FIG. 36 shows the lighting system according to the eighth embodiment when assembled, a light outlet side facing downwards in the figure.

The accompanying drawings are intended to impart further understanding of the embodiments of the invention. Said drawings illustrate embodiments and are used, in conjunction with the description, to explain principles and concepts of the invention. Other embodiments and many of the mentioned advantages emerge in view of the drawings. The elements of the drawings are not necessarily shown to scale.

In the figures of the drawings, elements, features and components that are the same, have the same function or act in the same manner—unless stated otherwise—are each provided with the same reference signs.

DETAILED DESCRIPTION OF EMBODIMENTS

Figure 1:
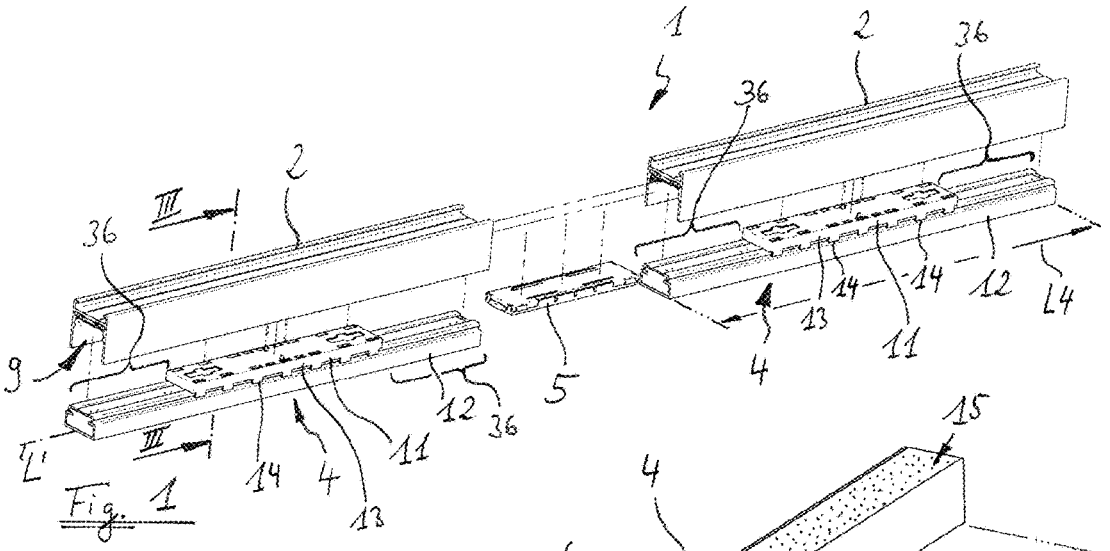
FIG. 1 is a perspective, exploded view of a lighting system according to a first embodiment.
Figure 2:
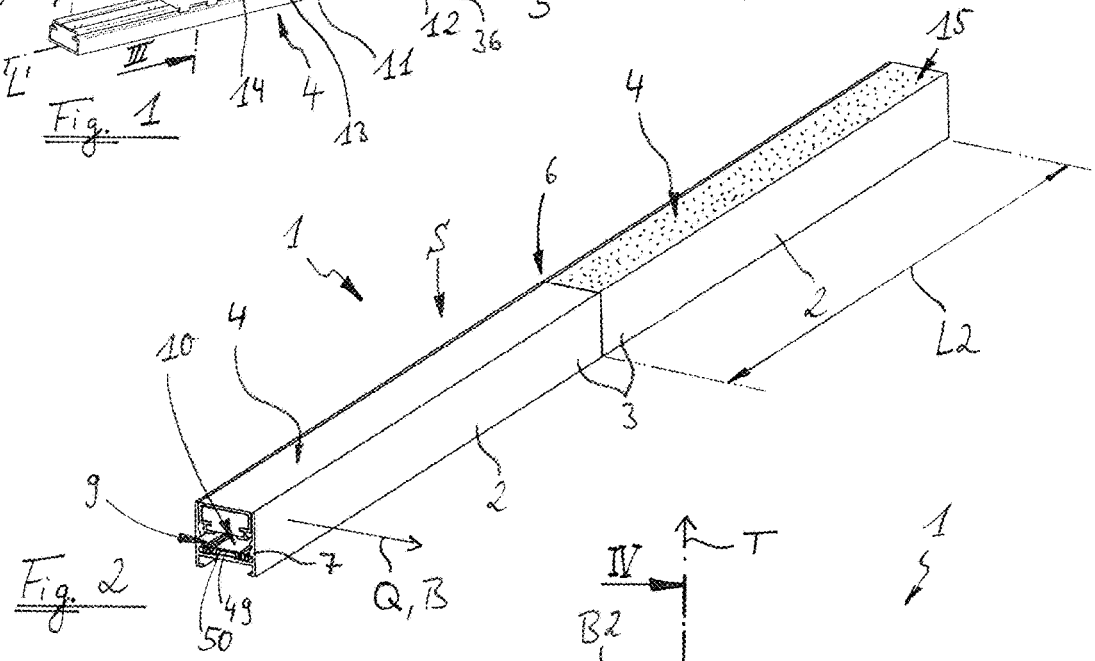
FIG. 2 shows a lighting system according to the first embodiment when assembled, a light outlet side facing upwards in the figure.
Figure 3:
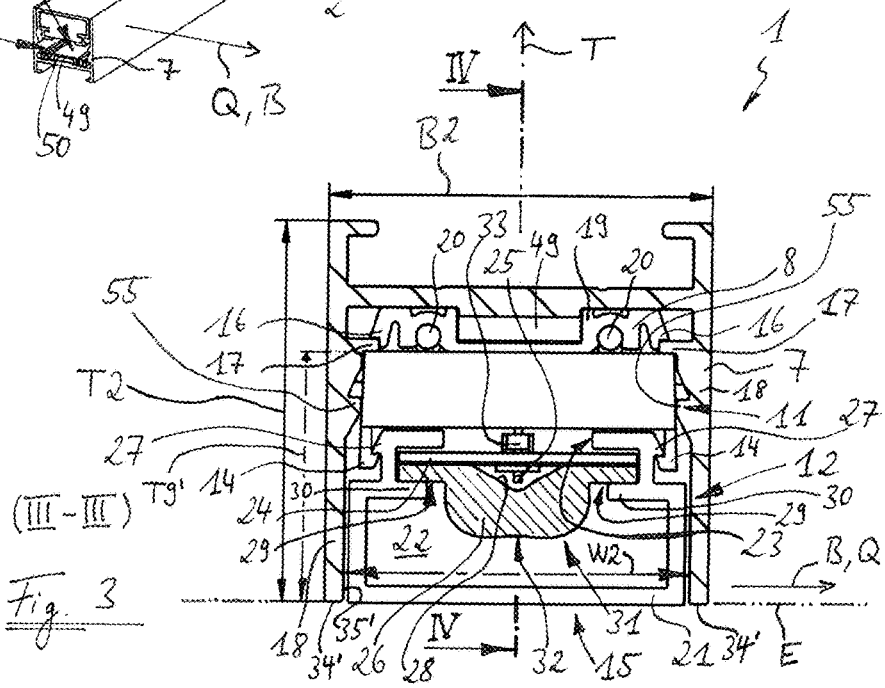
FIG. 3 shows a cross section III-III (see FIGS. 1 and 4) of the lighting system according to FIG. 2.

FIG. 1-3 show a lighting system 1 according to a first embodiment, which comprises a channel 3 formed having portions 2, and light units 4 and a connector 5. The channel 3 is formed such that the portions 2 are assembled so as to adjoin one another at the end faces thereof at a junction point 6. In this way, a long channel 3 can be produced from shorter portions 2 that are easy to handle. The channel 3 may be formed having two or more portions 2.

The length of a portion 2 is denoted in FIG. 2 as L2, it being possible for portions 2 of different lengths L2 to be used. For example, portions 2 for which L2=1,000 mm or L2=2,000 mm or L2=3,000 mm could be provided for the composition of the channel 3. It is conceivable for an individual cut to be made to any desired length L2.

The portions 2 are each formed having an extruded profile body 7, e.g. made of aluminium or an aluminium alloy, and a busbar portion 8 that may be latchingly attached therein. For example, the busbar portions 8 and the portions 2 have substantially the same length L2. In an inner region 9 of the channel 3, the channel 3 therefore comprises a busbar 10 that forms a part of the channel 3 and is formed having the busbar portions 8, which adjoin one another at the junction point 6.

The channel 3 may be built into a plasterboard ceiling or wall (not shown in any more detail in the drawings), for example so as to be edgeless. Once built-in, the channel 3 may thus be approximately flush with a ceiling plane E, for example. This is outlined in FIG. 3, by way of example. The channel 3 may thus be designed as a built-in channel for being built into a wall or ceiling. Additionally or alternatively, the channel 3 may be designed as a mounting channel, i.e. the channel 3 may be fixedly mounted on a wall or ceiling (not shown in any more detail in the drawings). Furthermore, additionally or alternatively the channel 3 may be designed to be mounted so as to be suspended from a ceiling.

The light units 4 and the connector 5 can each be inserted into the channel 3; the channel 3 thus receives the light units 4 and the connector 5. The busbar 10 is designed to supply each of the light units 4 inserted in the channel 3 with electrical current for the operation thereof, for example at a voltage of 48 volts. For this purpose, each of the light units 4 can be electrically coupled to the busbar 10.

The light units 4 are each linearly elongate and are together designed to form, when inserted in the channel 3, a continuous strip light during operation. The length of the light unit 4 is denoted as L4 (see FIG. 1). The strip light produced is substantially not interrupted in the region of the junction point 6; said light is continuous and aesthetically pleasing and has no noticeable non-luminous regions. The number of light units 4 may vary depending on the total length of the channel 3 and depending on the length L4 of the individual light units 4.

The bus bar 10, formed having the busbar portions 8, is arranged in the region of a base of the channel 3 (see FIG. 3), a main body 19 of the busbar portion 8 comprising latching elements 16 that latchingly engage behind rib-like undercuts 17 on the two side walls 18 of the profile body 7 in order to hold the busbar portions 18 in the profile body 7. The main body 19 is formed of a plastics material and receives two electrical conductors 20 for providing the electrical current.

A flow of current in the busbar 10 across the junction point 6 is made possible by the adjacent busbar portions 8 being electrically coupled to one another at the junction point 6 by means of the connector 5 inserted in the channel 3. Depending on the number of the portions 2 and junction points 6, a plurality of connectors 5 may be used.

Each of the light units 4 in FIG. 1 comprises a shallow power supply unit 11 and a light provision and optics unit 12. The power supply unit 11 is mechanically coupled to the light provision and optics unit 12. In this regard, the power supply unit 11 comprises a housing element 13 that is provided with latching devices 14. The latching devices 14, of which only some are provided with reference signs in FIG. 1 for the sake of clarity, latchingly connect, and thus mechanically couple, the power supply unit 11 to the light provision and optics unit 12.

The light units 4 each comprise a light outlet region 15 that is shown in dots in FIG. 2 for one light unit 4 and extends over substantially the entire length L4 of the light unit 4 and also over substantially the entire width thereof transverse to the longitudinal direction L'. In the light outlet region 15, the light unit 4 can emit light during operation.

FIG. 3 shows one of the light units 4 when inserted in the channel 3 in more detail. The light unit 4 in FIG. 3 comprises a light provision and optics unit 12 which, in turn, comprises a transparent, opal housing component 21. The housing component 21 is closed on the side of the light outlet region 15, provided with an interior 22, and provided with an opening 23 on a side facing the power supply unit 11.

The power supply unit 11 is mechanically coupled to the light provision and optics unit 12 such that the latching devices 14 engage behind sloping ribs 27, which are provided on either side of the housing component 21 and project laterally from the housing component 21, and thus mechanically couple the housing element 13 to the housing component 21.

Within the housing component 21, an LED circuit board 24 having light-emitting diodes or LEDs 25 is received, of which only one LED 25 can be seen in FIG. 3. Optionally further electrical and/or electronic components necessary for operating the LEDs 25 may be arranged on the LED circuit board 24.

The housing component 21 further receives a linearly elongate lens 26. In the embodiment shown in FIG. 3, the lens 26 shown in cross section in FIG. 3 is formed a cross section that is constant in a longitudinal direction thereof that extends in parallel with the longitudinal direction L' of the light unit 4 (see FIG. 1). The lens 26 is provided, on a side facing the LED circuit board 24, with a recess 28 that receives the LEDs 25. In cross section, the lens 26 is formed having narrow edge regions 29 which, together with the LED circuit board 24, are held by ribs 30 on the housing component 21 that project into the interior 22, and having a thicker middle region 31 which protrudes into the not completely filled interior 22 towards the light outlet region 15. In the cross section of the lens 26, the middle region 31 is rounded on either side of the middle and, in a middle part, is formed having a shallow depression 32 on a side of the lens 26 facing away from the LED circuit board 24. By means of the shape of the lens 26, an advantageously uniform light distribution on the light outlet region 15, formed by a region of the opal housing component 21 that is visible from the outside on the viewing side S, is achieved.

The LED circuit board 24 is supplied with electrical current through the opening 23. For this purpose, contact elements 33 are provided which allow the LED circuit board 24 of the light provision and optics unit 12 to be electrically coupled to the power supply unit 11.

FIG. 3 illustrates that, when inserted in the channel 3, the light unit 4 is, in the first embodiment, received substantially completely in the channel 3, i.e. within the inner region 9 of said channel. The housing component 21 may be flush with edges 34' of an opening 35' in the channel 3 or protrude slightly beyond the edges 34' by a few tenths of a millimeter, for example. In the embodiment in FIG. 3, the opening 35', which is formed between the side walls 18 of the profile body 7, is substantially filled by the light provision and optics unit 12 of the light unit 4. The channel 3 is therefore substantially filled by the light unit 4 on a viewing side S, in particular in a transverse direction Q of the channel 3, the light unit 4 occupying the largest part of the inner region 9 in FIG. 3.

FIG. 4 shows a central, longitudinal section of the lighting system 1 in FIG. 1, the channel 3 being shown in section; the light units 4 and the connector 5 are, however, not shown in section. FIG. 5 shows a detail X in the region of the junction point 6. FIG. 6 shows a further detail Y in the region of a power supply unit 11.

When inserted in the channel 3, as in FIG. 2-6, within the channel 3 each of the two light units 4 overlaps the connector 5, which is likewise inserted in the channel 3 in order to electrically couple the busbar portions 8 (see FIG. 5). More specifically, an end portion 34 of each of the two light units 4 overlaps the connector 5 such that, in a longitudinal direction of the channel, the end portions 34 directly adjoin one another on end faces 35 of the light units 4 at the location of the junction point 6.

As seen from the viewing side S of the channel 3, the light units 4 and therefore the lighting system 1, the connector 5 is therefore substantially completely concealed by the end portions 34.

A length L11 of the power supply unit 11 is considerably smaller than the length L4 of the light unit 4. For example, in FIG. 1-6, it holds that: L11≤(L4/2). In the same way as the length L4, the length L11 is taken to be in the longitudinal direction L' of the light unit 4. By way of example it may be that L11=148.4 mm.

The end portions 34 that overlap the connector 5 therefore form parts of end portions 36 in which the light provision and optics unit 12 projects beyond the power supply unit 11 in the longitudinal direction L' (see FIG. 1 and FIG. 4). FIG. 1 also shows that, in the first embodiment, the power supply unit 11 sits centrally on the light provision and optics unit 12 in the longitudinal direction L', and that an end portion 36 of the light provision and optics unit 12 thus projects on either side of the power supply unit 11 in the longitudinal direction L'.

By the light units 4 and the connector 5 overlapping within the channel 3, continuous strip lights can be produced that do not have unlit points, even if the channel 3 is composed of a plurality of portions 2. By means of parts of the end portions 36, the light unit 4 can therefore sit over the connector 5, with the light unit 4 and the connector 5 not being directly interconnected. The light unit 4 may simply rest on the shallow connector 5, or a small gap may be formed between the light unit 4 and the connector 5 in the portion 36. In the longitudinal direction L', the connector 5 is shorter than the power supply unit 11, i.e. L5<L11.

Figures 7, 8, 9, 29, 30:
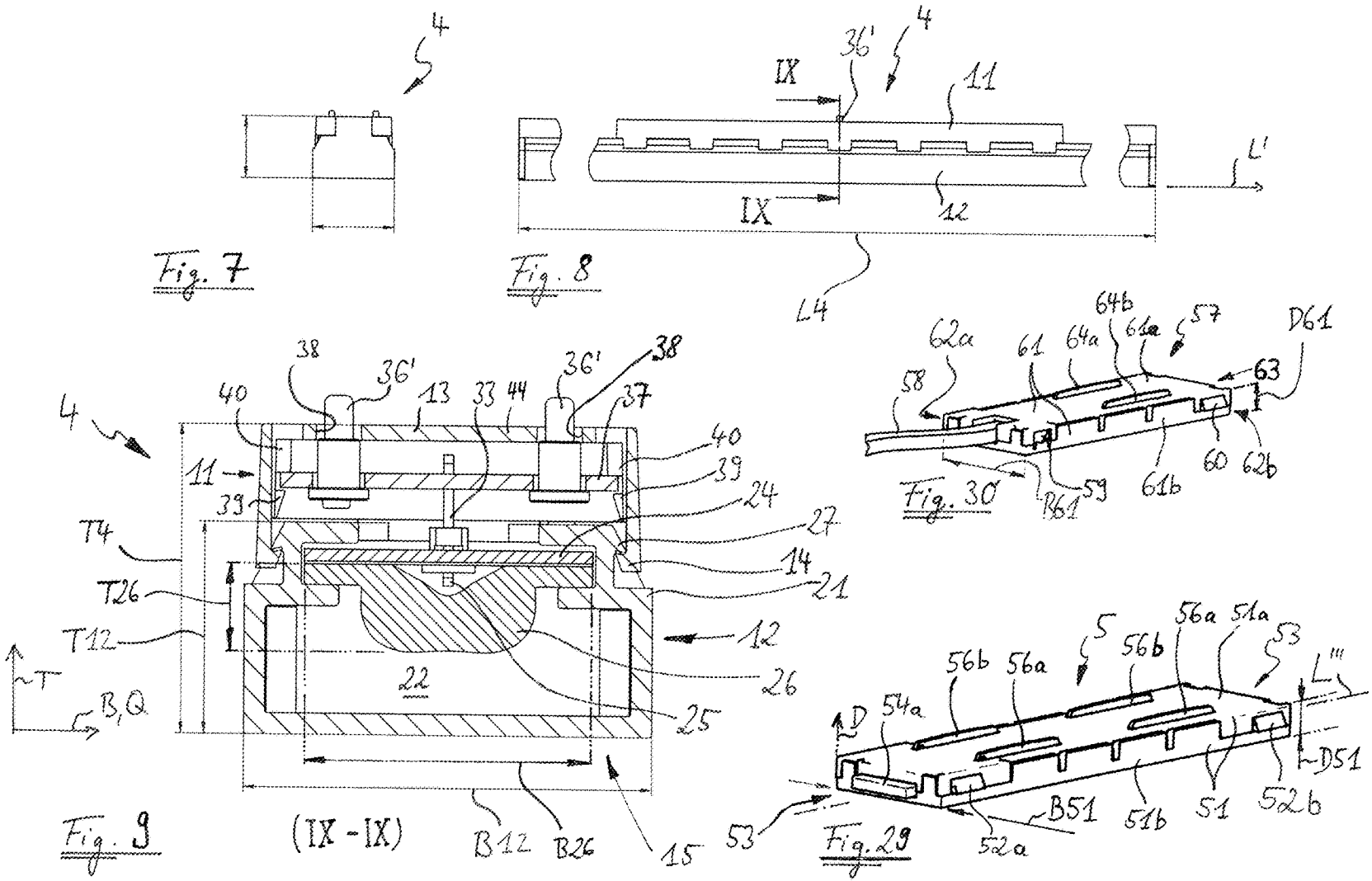
FIG. 7 is an end view of a light unit of a lighting system according to the first embodiment.
FIG. 8 is a side view of the light unit in FIG. 7.
FIG. 9 shows a cross section IX-IX (see FIG. 8) of the light unit in FIG. 7.
FIG. 29 is a perspective view of a connector for the lighting system according to each of the embodiments in FIGS. 1 to 28 and 31 to 36.
FIG. 30 is a perspective view of a current supply unit for the lighting system according to each of the embodiments in FIGS. 1 to 28 and 31 to 36.
Figure 11:
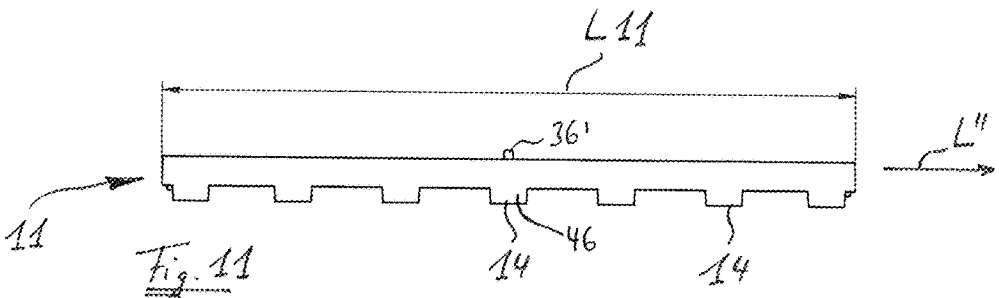
FIG. 11 is a side view of the power supply unit in FIG. 10.

The light unit 4 is shown separately in FIG. 7-9. In the cross section in FIG. 9, additional internal parts of the power supply unit 11 can be seen. Further features of the power supply unit 11 are shown in FIG. 10-14.

The power supply unit 11 comprises contact devices 36' that are in the form of pins in FIG. 9. The contact devices 36' are provided for each being brought into contact with one of the conductors 20 and thereby allowing the light unit 4 to be electrically coupled to the busbar 10.

Figure 14:
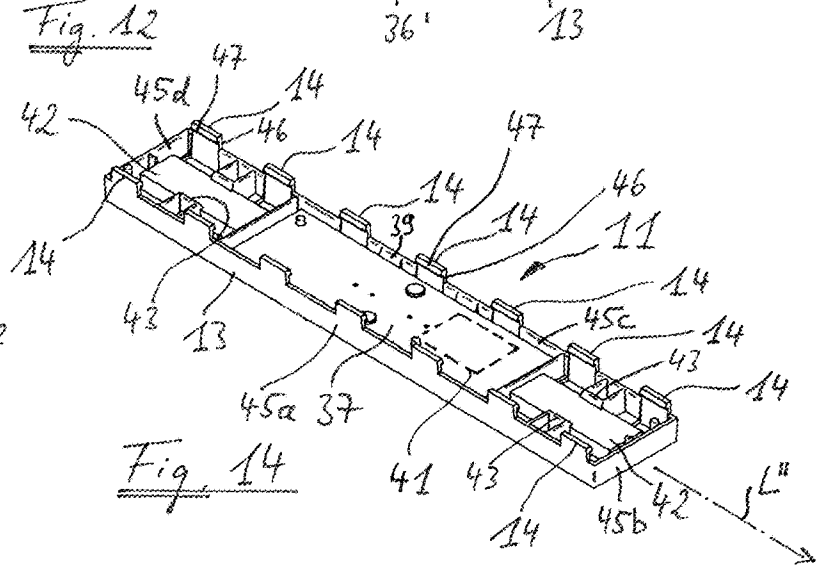
FIG. 14 is a perspective view of the power supply unit in FIG. 10, a second side of the power supply unit, which faces a light provision and optics unit (not shown in FIG. 14) when the light unit is assembled, facing upwards.

A circuit board 37 is received within the housing element 13 (see FIG. 9 and FIG. 14). The circuit board 37 is held in the housing element 13 by means of latching elements 39 and rests on shoulders 40 of the housing element 13.

The contact devices 36' are connected to the circuit board 37. Furthermore, on the circuit board 37 a module 41 is provided, in particular implemented as a part of the circuit board or arranged thereon, the module 41 being designed to wirelessly receive control signals for switching and/or controlling the light output of the light provision and optics unit 12 of the light unit 4. This allows for the ability to wirelessly switch and/or control, in particular dim, the light output of the light unit 4. In addition to or as part of the module 41, further devices or components may be provided on the circuit board 37 in order to process and/or analyse the received switching and/or control signals and to provide electrical current, for operating the LEDs 25, by means of the contact elements 33 of the LED circuit board 24 on the basis of the switching and/or control signals. In this way, the light provision and optics unit 12 is thus supplied with current on the basis of wireless switching and/or control signals, which may in particular be radio signals. The module 41 may in particular be designed as or comprise what is known as a Zigbee module. The module 41 is shown schematically in FIG. 14. The power supply unit 11 can therefore also be considered to be a communications unit of the light unit 4, a shallow design of the circuit board 37 and of the components arranged thereon advantageously contributing to the power supply unit 11 being shallow and space-saving.

As seen in a longitudinal direction L" of the power supply unit 11, which is in parallel with the longitudinal direction L' in the assembled state, the circuit board 37 is arranged centrally within the housing element 13. In the longitudinal direction L", at each of the two ends of the circuit board 37, each in an end region of the housing element 13, a cuboid permanent magnet 42 is received in the housing element 13, i.e. the power supply unit 11 comprises two permanent magnets 42. Each permanent magnet 42 is held by latching devices 43 (in the form of sloped lugs in the example shown) which engage behind the permanent magnet 42.

The housing element 13 comprises, on a side facing the base of the channel 3 and thus the busbar 10 when the light unit 4 is inserted in the channel 3, a cover portion 44 and wall portions 45*a-d* that protrude substantially perpendicularly from the cover portion 44 on all four edges thereof. The wall portions 45*a* and 45*c* on the longitudinal sides of the housing element 13 are each lengthened by mutually spaced projections 46 in the manner of crenellations in the extension direction of said wall portions that is normal to the cover portion 44. Each of the projections 46 has, at the free end thereof, a latching hook 47. The projections 46 having the latching hooks 47 form the latching devices 14. For the sake of clarity, this is only shown for some latching devices 14 in FIG. 14.

Figure 12:
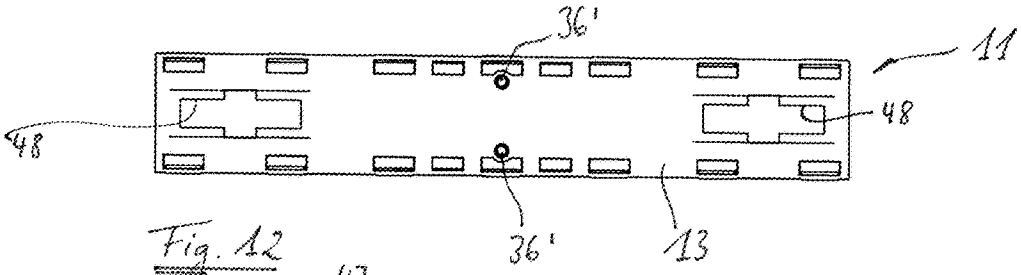
FIG. 12 is a plan view of the power supply unit in FIG. 10.
Figure 13:
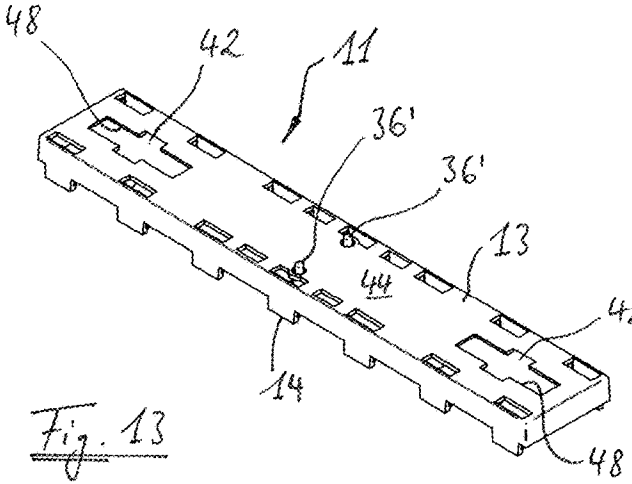
FIG. 13 is a perspective view of the power supply unit in FIG. 10, a first side of the power supply unit, which faces a busbar of the channel when the light unit is inserted in the channel, facing upwards.

The cover portion 44 is provided with two cross-shaped holes 48, it being possible to see one permanent magnet 42 through each of the holes 48 (see FIGS. 12 and 13). The cover portion 44 also comprises through-openings 38, by means of which the contact devices 36' pass through the housing element 13.

From a rear side of the light provision and optics unit 12 facing away from the light outlet region 15 (see FIG. 9, for example), the power supply unit 11 is latched on the housing component 21. The plurality of latching hooks 47 engage behind the longitudinal ribs 27, as a result of which the power supply unit 11 and the light provision and optics unit 12 are securely coupled to one another.

The power supply unit 11 is not only used to supply the light provision and optics unit 12 with electrical power, but rather is also designed as a holding unit for the light unit 4 in order to hold the light unit 4 in the channel 3. Once inserted in the channel 3, the light unit 4 is magnetically coupled to the channel 3 by means of the permanent magnets 42 and reliably held in the channel 3. For this purpose, the portions 2 of the channel 3 comprise portions 49 of a steel core 50, the steel core 50, as a ferromagnetic element, interacting with the permanent magnet 42 so as to attach the light units 4. In the same way as the busbar 10, the steel core 50 also forms part of the channel 3. The portions 49 are held within the profile body 7 by means of the main body 19 (see in particular FIGS. 2 and 3).

Wirelessly controlling the light unit 4 by means of the module 41 makes it possible to circumvent the space requirements associated with a wired control system. Additional contact elements for picking up the control signals, and space therefor on the circuit board, are not necessary. This makes it possible to keep the power supply unit 11 particularly slim and narrow. Furthermore, it is also possible for the connector 5 to be very shallow, especially as no control lines, rather only the two conductors 20, have to be electrically coupled across the junction point 6.

The housing element 13 may be injection-moulded. The housing element 13 may be designed as an injection-moulded plastics part.

FIG. 29 shows the connector 5 separately. The connector 5 comprises a substantially cuboid connector housing 51 formed having two parts. The connector housing 51 is formed having a connector housing part 51*a* and a connector housing part 51*b*, the connector housing parts 51*a*, 51*b* each being formed of a plastics material. The connector housing parts 51*a*, 51*b* may also be injection-moulded, for example.

Close to the four corners of the cuboid connector 5, movable catches 52*a*, 52*b* are arranged on the longitudinal sides of said connector. Only two of these are shown in FIG. 29; however, it is understood that the further two catches 52 are provided on the longitudinal side of said connector that is obscured in FIG. 29, so as to be symmetrical with respect to the longitudinal direction L''' of the connector 5; in particular, the second catch 52*a* is in symmetry with catch 52*a* that can be seen in FIG. 29, and the second catch 52*b* is in symmetry with the catch 52*b* that can be seen in FIG. 29.

The connector 5 also comprises, at each of the opposite end-face ends 53, an actuation element 54*a*, 54*b*, of which likewise only one can be seen in FIG. 29, although both are shown in FIG. 5.

In order to be actuated, the actuation elements 54*a* and 54*b* can be pushed in, as a result of which the catches 52*a*, 52*b* can be retracted into the connector housing 51, which catches protrude from the connector housing 51 when the actuation elements 54*a*, 54*b* are not actuated. For example, the actuation element 54*a* may act on the two catches 52*a* at one end-face end 53 of the connector housing 51, and the actuation element 54*b* may act on the catches 52*b* at the other end-face end 53 of the connector housing 51. An appropriate mechanism may be provided inside the connector housing 51.

The catches 52*a*, 52*b* form latching devices, which make it possible to latchingly, and detachably, mechanically couple the connector 5 to two adjoining portions 2 of the channel 3 at the junction point 6 in a space-saving manner. In the process, the catches 52*a* and 52*b* engage behind longitudinal ribs 55 in the inner region 9 of the channel 3 (see FIG. 3), the longitudinal ribs 55 being formed in the side walls 18 of the profile body 7 and being sloped towards the opening 35'. In this way, the connector 5 is held on the portions 2 of the channel 3 and can, in addition to the electrical coupling of the busbar portions 8, also mechanically guide the portions 2 in a simple manner in the region of the junction point 6 and make it easier to align the portions 2 with one another.

By actuating the actuation elements 54*a, b*, the catches 52*a, b* can be retracted into the connector housing 51, as a result of which the catches 52*a, b* are disengaged from the longitudinal ribs 55 (see FIG. 3), and the connector 5 can be removed again.

In order to electrically couple the busbar portions 8 that meet at the junction point 6, the connector 5 comprises two pairs of contact elements 56*a* and 56*b* (see FIG. 29). When the connector 5 is inserted into the channel 3, the contact elements 56*a, b* come into contact with the conductors 20 on either side of the junction point 6 such that the contact elements 56*a* connect portions of one conductor 20, and the contact elements 56*b* connect portions of the other conductor 20, across the junction point 6. For this purpose, both the contact elements 56*a* and the contact elements 56*b* are electrically interconnected in the connector housing 51.

FIG. 3 illustrates, for the first embodiment, a depth direction T of the channel 3 and a transverse direction Q of the channel 3 that is normal and thus transverse to the depth direction T.

In FIG. 9, for the state in which the light unit 4 is inserted in the channel 3, an extension of the light unit 4 in parallel with the depth direction T is denoted as T4, an extension of the light provision and optics unit 12 in parallel with the depth direction T is denoted as T12, and an extension of the lens 26 in parallel with the depth direction T is denoted as T26. The measurement of T12 and T4 does not take into account the contact elements 33 and the contact devices 36' (see FIG. 9).

In FIG. 9, in the transverse direction Q, which extends in parallel with a width direction B (see FIG. 3) of each of the lens 26, the light provision and optics unit 12 and the power supply unit 11 when the light unit 4 is inserted, the extension of the light provision and optics unit 12 is denoted as B12, and the extension of the lens 26 is denoted as B26. For the lens 26 in FIGS. 3 and 9, it holds that B26>T26.

Figure 10:
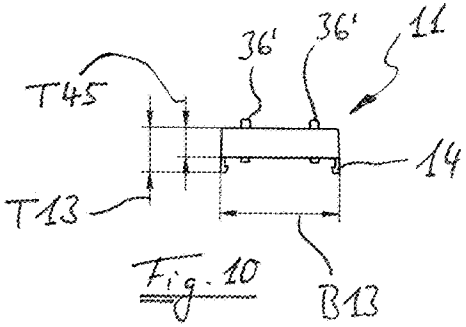
FIG. 10 is an end view of a power supply unit for the light unit of the lighting system according to the first embodiment.

Furthermore, for the state in which the light unit 4 is inserted in the channel 3, FIG. 10 shows an extension B13 of the housing element 13 in the transverse direction Q and thus in a width direction of the housing element 13, an overall extension T13 of the housing element 13 in parallel with the depth direction T, and an extension T45 of said housing element in parallel with the depth direction T without the projections 46. The measurement of T13 and T45 does not take into account the contact devices 36' either.

Furthermore, FIG. 3 shows the outer dimensions in the cross section of the channel 3, i.e. the height T2 of the channel 3 and of the portions 2 in parallel with the depth direction T, and the width B2 of the channel 3 and of the portions 2 in the transverse direction Q and thus normal to the depth direction T.

In the first embodiment, it may be that B2=31.0 mm and T2=31.0 mm, by way of example.

For the light unit 4 of the first embodiment, it holds that B13>0.9 B12. Therefore, the width extension of the housing element 13, and thus also of the power supply unit 11, in the transverse direction Q normal to the depth direction T is greater than 90 percent of the width extension B12 of the light provision and optics unit 12 in said direction. By way of example, in the first embodiment it holds that B12=27.2 mm and B13=25.7 mm.

Furthermore, by way of example, for the light unit 4 of the first embodiment it holds that T12=14.1 mm and T4=20.5 mm. Thus, in the first embodiment, it further holds that T4<B12, B12 also indicating the maximum extension of the light unit 4 in the width direction B, i.e. in the transverse direction Q.

Furthermore, by way of example, in the case of the power supply unit 11 according to the first embodiment, it holds that T13=9.5 mm and T45=6.2 mm.

By way of example, a thickness D51 of the connector housing 51 (see FIG. 29), which denotes an extension of the connector housing 51 in the thickness direction D of the connector 5 and does not take the contact elements 56*a, b* into account, is approximately 6 mm. When the connector 5 is inserted in the channel 3, the thickness direction D is substantially in parallel with the depth direction T of the channel 3. In particular, the thickness D51 is approximately of a dimension (by way of example, it holds that T4−T12=6.4 mm in this case) at which, in the case of the light unit 4 (see FIG. 9), the housing element 13 projects, in parallel with the depth direction T, beyond the light provision and optics unit 12, and in particular beyond the housing component 21 thereof, when the light unit 4 is inserted in the channel 3. For example, the thickness D51 is not greater than the projection T4–T12.

By way of example, a depth T9' of the channel 3 (see FIG. 3), available for receiving the light unit 4, is approximately 20.5 mm. The light unit 4 received in the channel 3 thus ends substantially flush with the edges 34'. Furthermore, by way of example, an inner width W2 of the channel 3 (see FIG. 3) in the region of the opening 35' is approximately 28 mm.

Furthermore, FIG. 3 shows that the width B13 of the housing element 13 is selected substantially such that the power supply unit 11 can be easily introduced between the side walls 18, the spacing of which at the location of the power supply unit 11 is, in the transverse direction Q, smaller than the width W2 when said power supply unit is inserted. When the connector 5 is inserted, the width B51 of the connector housing 51 (see FIG. 29) in the transverse direction Q may substantially correspond to the width B13.

Figures 15, 15A, 15B, 15C, 16:
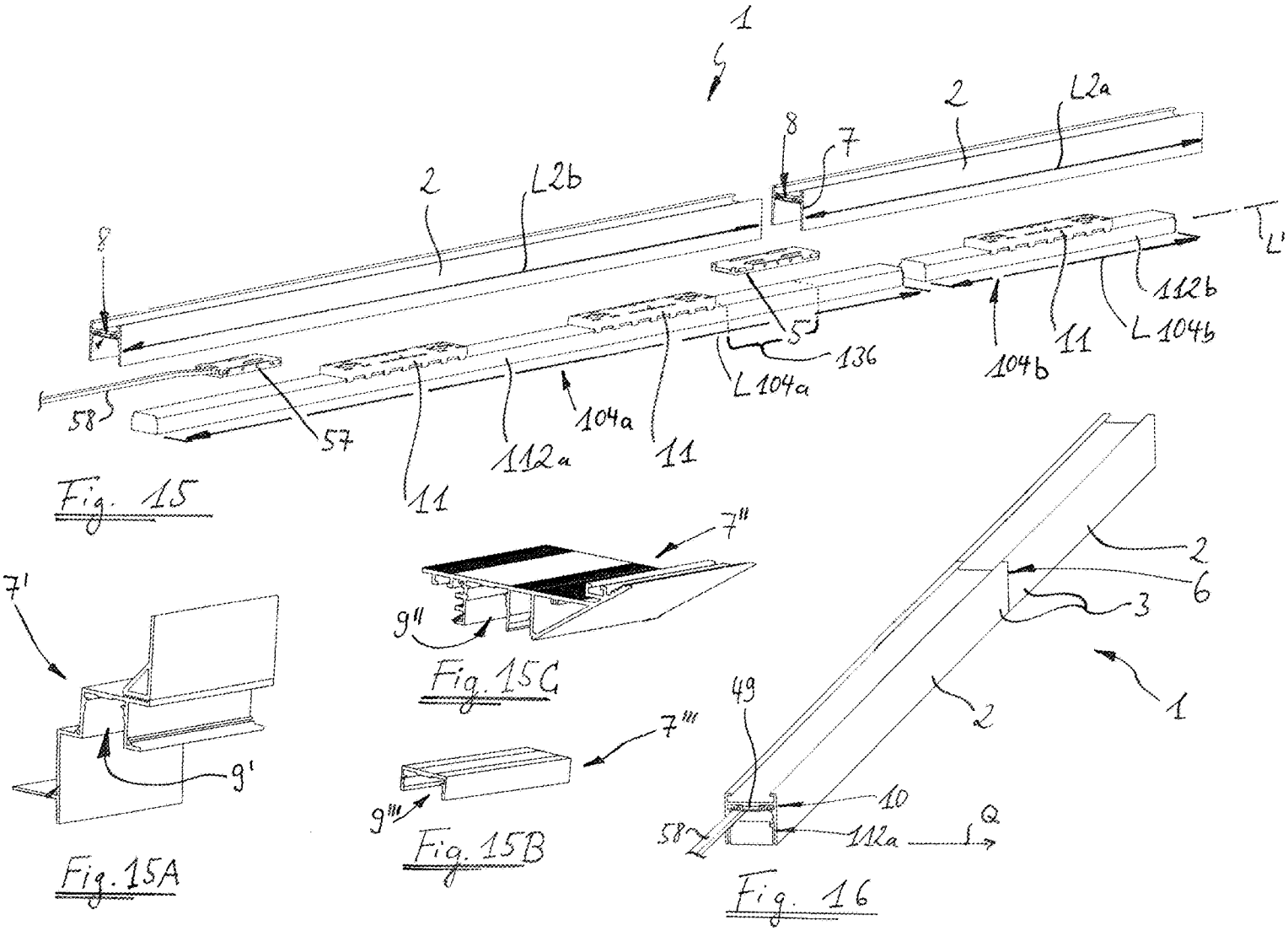
FIG. 15 is a perspective, exploded view of a lighting system according to a second embodiment.
FIG. 15A shows a channel according to a first variant.
FIG. 15B shows a channel according to a second variant.
FIG. 15C shows a channel according to a third variant.
FIG. 16 shows the lighting system according to the second embodiment when assembled, a light outlet side facing downwards in the figure.
Figures 21, 22, 24:
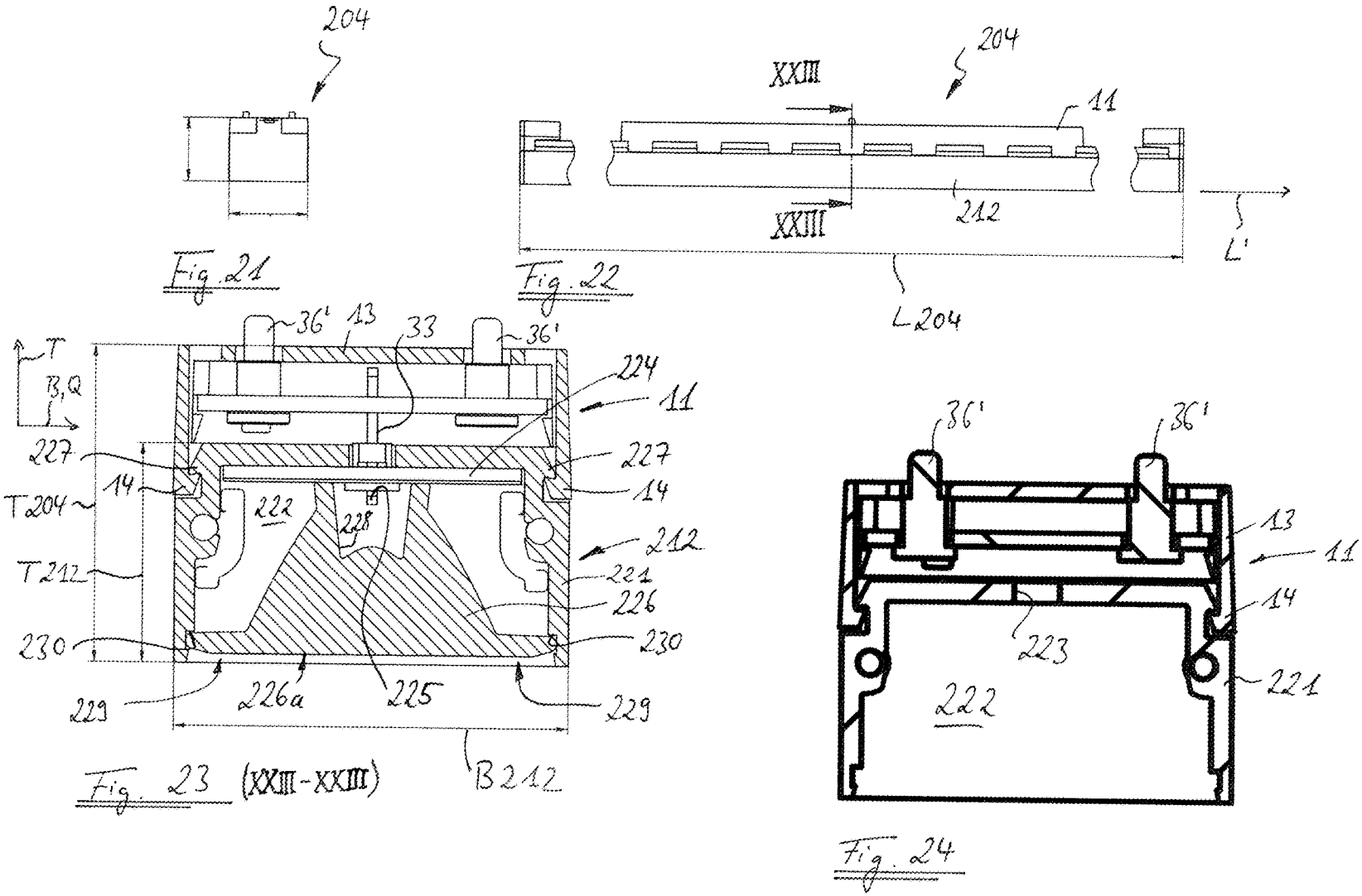
FIG. 21 is an end view of a light unit according to a third embodiment.
FIG. 22 is a side view of the light unit in FIG. 21.
FIG. 24 shows a further cross section of the light unit in FIG. 21, only a housing component of the light provision and optics unit of the light unit being shown.

FIG. 15 shows a lighting system 1 according to a second embodiment. The following is intended to explain the differences in relation to the first embodiment. For other features, in particular relating to the channel 3 and the portions 2 thereof and in particular also relating to the busbar 10 and the busbar portions 8 thereof, reference is made to the above observations concerning the first embodiment.

For illustration, two portions 2 of the channel 3 that have different lengths L2*a*, L2*b* are shown in FIG. 15. FIG. 15 also shows two light units 104*a*, 104*b* having different lengths L104*a*>L104*b*. Each of the light units 104*a*, 104*b* comprises a light provision and optics unit 112*a*, 112*b*, respectively. Furthermore, the longer light unit 104*a* comprises, for example, two identical power supply units 11, while the shorter light unit 104*b* is provided with only one power supply unit 11.

Furthermore, a portion 136 of the light provision and optics unit 112*a* completely overlaps the connector 3 (see FIG. 15). The connector 5 is substantially completely concealed by the portion 136; however, in the arrangement in FIG. 15, the two light units 104*a* and 104*b* adjoin one another on the end faces thereof not in front of the connector 5, but outside of the region in which the connector 5 is located in the channel 3. The portion 136 that overlaps the connector 5 is not therefore an end portion, but an inner portion of the light provision and optics unit 112*a*.

It is also conceivable for a portion 136 of a light provision and optics unit 112*a* that is located between two power supply units 11 to overlap the connector 5, provided that the power supply units 11 are spaced far enough apart from one another.

By way of example, FIGS. 15A, 15C and 15B show alternative profile bodies 7', 7'', 7''' having the inner region 9', 9'', 9''', respectively, which may be used for alternative mounting situations in place of the profile body 7 in FIG. 3 for the channel 3 according to the second, or also the first, embodiment.

FIG. 15 also shows a current supply unit 57 for supplying electrical current to the busbar 10 of the channel 3. As can be seen in FIG. 15, the current supply unit 57 can be inserted into the channel 3 in a similar manner to the connector 5, such that said unit is overlapped by the light unit 4 and in particular by a portion of the light provision and optics unit, e.g. 112*a*, and is completely concealed by said portion, for example.

FIG. 30 shows the shallow current supply unit 57, which can be latched into the channel 3, together with a piece of line 58. The current supply unit 57 comprises a substantially cuboid current supply unit housing 61, which is formed having two housing parts 61*a*, 61*b*. The housing parts 61*a*, 61*b* are each formed of a plastics material and are likewise injection-moulded, for example.

At one end-face end 62*a* of the current supply unit 57, the flexible, current-carrying line 58 enters the housing 61, while, at the opposite end-face end 62*b* of the current supply unit 57, said current supply unit comprises an actuation element 63 (not visible in FIG. 30), which is designed in the same way as the actuation element 54*a* or 54*b* of the connector 5.

Adjacently to the end 62*a*, the current supply unit 57 comprises latching lugs 59, which are arranged on the longitudinal sides so as to be symmetrical with respect to the longitudinal direction of said current supply unit, while, adjacently to the end 62*b*, the current supply unit 57 comprises, on the longitudinal sides thereof, two movable catches 60. The catches 60 are also symmetrical with respect to the longitudinal direction of the current supply unit 57. The latching lugs 59 can each engage behind one of the longitudinal ribs 55 (see FIG. 3) in a resiliently latching manner. In the same way as the catches 52*a*, 52*b* in FIG. 29, the catches 60 are also designed to engage behind the longitudinal ribs 55. The latching lugs 59 and the catches 60 thus form latching devices that make it possible to latchingly, and releasably, mechanically couple the current supply unit 57 to the channel 3.

In order to be actuated, the actuation element 63 can be pushed in, as a result of which, in the same way that the catches 52*a*, 52*b* of the connector 5 function, the catches 60 can be withdrawn, which catches protrude from the current supply unit housing 61 when said actuation element is not actuated. Once the actuation element 63 has been actuated, the coupling of the current supply unit 57 to the channel 3 is released.

An electrical coupling of the busbar 10 to the current supply unit 57 is achieved by contact elements 64*a*, 64*b*, which are each electrically connected to a conductor of the line 58. When the current supply unit 57 is inserted into the channel 3, the contact element 64*a* comes into contact with one conductor 20 (see FIG. 3), and the contact element 64*b* comes into contact with the other conductor 20.

A thickness 61 of the current supply unit housing 61 in a thickness direction, which is substantially in parallel with the depth direction T when the current supply unit 57 is inserted, may correspond approximately to the thickness D51 of the connector housing 51, for example. Furthermore, a width B61 of the current supply unit housing 61 in a width direction, which extends normal to the depth direction T when the current supply unit 57 is inserted, may correspond approximately to the width B51 of the connector housing 51, for example.

FIG. 16 shows how, when the lighting system is assembled, the line 58 may be guided out of the channel 3 at the end thereof, between the busbar 10 and the light provision and optics unit 112*a*, for example, in order to connect the line 58 to a current source, such as a converter.

A light unit 104 (not shown in FIG. 15) for the lighting system according to the second embodiment is shown in more detail in FIG. 17-20, the following observations concerning FIG. 17-20 similarly applying to the light units 104*a*, 104*b* in FIG. 15.

The light unit 104 comprises a power supply unit 11 and a light provision and optics unit 112. The power supply unit 11 in FIG. 17-20 is designed in the same way as in the first embodiment. The differences between the light provision and optics unit 112 and the light provision and optics unit 12 are explained in the following.

The light provision and optics unit 112 comprises a housing component 121 that is open towards the viewing side S and the light outlet region 15. In an interior 122 of the housing component 121, a linearly elongate lens 126 is received and held in the housing component 121, for example, by latching edge regions 129 of the lens 126 into shallow recesses 130. A front 126*a* of the lens 126 through which light is emitted is substantially planar.

An LED circuit board 124 having LEDs 125 is received in the housing component 121. The lens 126 has a recess 128 which is opposite the LEDs 125. The cross section of the lens 126 is substantially constant in a longitudinal direction thereof. An extension of the lens 126, when the light unit 104 is inserted in the channel 3, in parallel with the depth direction T is, in the case of the lens 126 too, smaller than an extension of the lens 126 in the transverse direction Q normal to the depth direction T. The lens 126 is designed to produce a symmetrical light distribution.

In order for the power supply unit 11 to be latched to the light provision and optics unit 112 in the same way as in the first embodiment, the housing component 121 comprises lateral longitudinal ribs 127, behind which the latching devices 14 can be latched when the light unit 104 is assembled.

By way of example, the extension T104 of the light unit 104 in parallel with the depth direction T may be T104=20.5 mm in FIG. 19. Furthermore, by way of example, an extension T112 of the light provision and optics unit 112 in parallel with the depth direction T may be T112=14.3 mm in FIG. 19. By way of example, the extension B112 of the light provision and optics unit 112 in the width direction B, which extends in parallel with the transverse direction Q when the light unit 104 is inserted, is B112=25.4 mm in FIG. 19. For the light unit 104, it holds that B13>0.9 B112, in particular that B13>B112. Furthermore, in the second embodiment it holds that T104<B112 and T104<B13. The projection of the power supply unit 11 beyond the light provision and optics unit 112 by T104–T112=6.2 mm substantially corresponds to the thickness D51 of the connector housing 51 or is slightly larger than D51.

FIG. 21-24 illustrate a light unit 204 according to a third embodiment. The following is intended to describe primarily the differences in comparison with the light unit 104.

The light unit 204 comprises a power supply unit 11 and a light provision and optics unit 212, a housing component 221 of the light provision and optics unit 212 substantially being designed in the same way as the housing component 121 in FIG. 19 and comprising an interior 222, an opening 223 towards the power supply unit 11, lateral longitudinal ribs 227 for being latched to the latching devices 14 of the power supply unit 11, and recesses 230.

In the interior 222, a linearly elongate lens 226 is received, the cross section of which is substantially constant in a longitudinal direction of the lens 226. A front 226*a* of the lens 226 through which light is emitted is also substantially planar, as far as edge zones. Edge regions 229 of the lens 226 are latched into the recesses 230 in the housing component 221.

An LED circuit board 224 having LEDs 225 is also received in the housing component 222. Facing the LED circuit board 224, the lens 226 has a recess 228 in which the LEDs 225 are arranged and into which they radiate.

In the case of the lens 226 too, the extension thereof, when the light unit 204 is inserted in the channel 3, in parallel with the depth direction T is smaller than the extension of the lens 226 in the transverse direction Q normal to the depth direction T. The lens 226 may be designed to focus the emitted light to a greater degree.

By way of example, the extension T204 of the light unit 204 in parallel with the depth direction T may be T204=20.3 mm in FIG. 23. Furthermore, by way of example, an extension T212 of the light provision and optics unit 212 in parallel with the depth direction T may be T212=14.1 mm in FIG. 23. By way of example, the extension B212 of the light provision and optics unit 212 in the width direction B, which in turn extends in parallel with the transverse direction Q when the light unit 204 is inserted, is B212=25.4 mm in FIG. 23. For the light unit 204, it holds that B13>0.9 B212, in particular that B13>B212. Furthermore, in the third embodiment it holds that T204<B212 and T204<B13. In this embodiment too, the projection of the power supply unit 11 beyond the light provision and optics unit 212 by T204–T212=6.2 mm substantially corresponds to the thickness D51 of the connector housing 51 or is slightly larger than D51.

FIGS. 25 and 26 illustrate a light unit 304 according to a fourth embodiment. With regard in particular to the power supply unit 11 of the light unit 304, reference is again made to the above observations. The following is intended to describe primarily the differences between the light unit 304 and the above embodiments.

The light unit 304 comprises a light provision and optics unit 312 that comprises a housing element 321 having an interior 322. An LED circuit board 324, having LEDs 325, and a lens 326 are received in the interior 322. The lens 326 is linearly elongate, has a cross section that is substantially constant in the longitudinal direction thereof, and is designed to produce an asymmetric light distribution.

A front 326*a* of the lens 326 through which light is emitted is also substantially planar, as far as edge zones. Edge regions 329 of the lens 326 are latched into recesses 330 in the housing component 321 (see FIG. 26). In this case, in the region of the front 326*a*, the lens 326 does not extend over the entire width of the housing component 321, but rather an opening in the housing component 321, in the region of the edges of which opening the recesses 330 are arranged, is narrower than in the examples in FIG. 19 or 23 on account of a wall portion 321*a* that is substantially parallel to the front 326*a*.

Facing the LED circuit board 324, the lens 326 has a recess 328 in which the LEDs 325 are arranged and into which they radiate. In the case of the lens 326 too, the extension thereof, when the light unit 304 is inserted in the channel 3, in parallel with the depth direction T is smaller than the extension of the lens 326 in the transverse direction Q normal to the depth direction T.

By way of example, the extension T304 of the light unit 304 in parallel with the depth direction T may be T304=25.2 mm in FIG. 26. Furthermore, by way of example, an extension T312 of the light provision and optics unit 312 in parallel with the depth direction T may be T312=19 mm in FIG. 26. By way of example, the extension of the light provision and optics unit 312 in the width direction B, which in turn extends in parallel with the transverse direction Q when the light unit 304 is inserted, is B312=25.4 mm in FIG. 26. For the light unit 304, it thus holds that B13>0.9 B312, in particular that B13>B312. Furthermore, in the fourth embodiment it holds that T304<B312 and T304<B13. However, in the fourth embodiment, T304 and B312 are practically equal. In particular, when the light unit 304 is inserted into the channel 3 in FIG. 3, the light unit 304 protrudes beyond the edges 34' and out of the opening 35' in the channel 3. In this embodiment too, the projection of the power supply unit 11 beyond the light provision and optics unit 312 by T304–T312=6.2 mm substantially corresponds to the thickness D51 of the connector housing 51 or is slightly larger than D51.

FIG. 27 illustrates a fifth embodiment, a light unit 404 projecting from the interior 9 beyond the edges 34' and out of the opening 35' in the channel 3. All the same, the light unit 404 overlaps the connector 5 (not shown in FIG. 27) within the channel 3.

In the sixth embodiment of FIG. 28, a light unit 504 is provided, which is dimensioned in relation to the channel 3 such that, when inserted, the light unit 504 is offset with respect to the edges 34'. The light unit 504 is thus completely received in the interior 9 of the channel 3, but not flush with the edges 34' of the opening 35'.

FIGS. 31 and 32 illustrate a light unit 604 according to a seventh embodiment. In the same way as the light unit 304, the light unit 604 is also used to produce an asymmetric light distribution. The following is intended to primarily describe the differences between the light unit 604 and the light unit 304, reference otherwise being made to the above observations.

In addition to an LED circuit board 624 having LEDs 625, a housing element 621 of a light provision and optics unit 612 of the light unit 604 receives, in the interior 622 thereof, a linearly elongate lens 626 which, however, on the viewing side S, extends over substantially the entire width of the housing element 621 (see FIG. 32), unlike the above-described lens 326. In FIG. 32, the substantially planar front 626*a* of the lens 626 through which light is emitted thus extends over a large part of the width of the housing element 621. Edge regions 629 of the lens 626 are latched into recesses 630 in the housing component 621.

Facing the LED circuit board 624, the lens 626 also has a recess 628 in which the LEDs 625 are arranged. In the case of the lens 626 too, the extension of the lens 626, when the light unit 604 is inserted in the channel 3, in parallel with the depth direction T is smaller than the extension of the lens 626 in the transverse direction Q normal to the depth direction T.

By way of example, the extension T604 of the light unit 604 in parallel with the depth direction T may be T604=20.3 mm in FIG. 32. Furthermore, by way of example, an extension T612 of the light provision and optics unit 612 in parallel with the depth direction T may be T612=14.1 mm in FIG. 32. By way of example, the extension of the light provision and optics unit 612 in the width direction B, which in turn extends in parallel with the transverse direction Q when the light unit 604 is inserted, is B612=25.4 mm in FIG. 32. For the light unit 604, it thus holds that B13>0.9 B612, in particular that B13>B612. Furthermore, in the seventh embodiment it holds that T604<B612 and T604<B13. In particular, when the light unit 604 is inserted into the channel 3 in FIG. 3, the light unit 604 is substantially flush with the edges 34'. In this embodiment too, the projection of the power supply unit 11 beyond the light provision and optics unit 612 by T604–T612=6.2 mm substantially corresponds to the thickness D51 of the connector housing 51 or is slightly larger than D51.

FIG. 33-36 show a lighting system 1 according to an eighth embodiment, the following being intended to explain the differences from the second embodiment. Reference is otherwise made to the observations concerning the second embodiment.

Figures 33, 33A, 34:
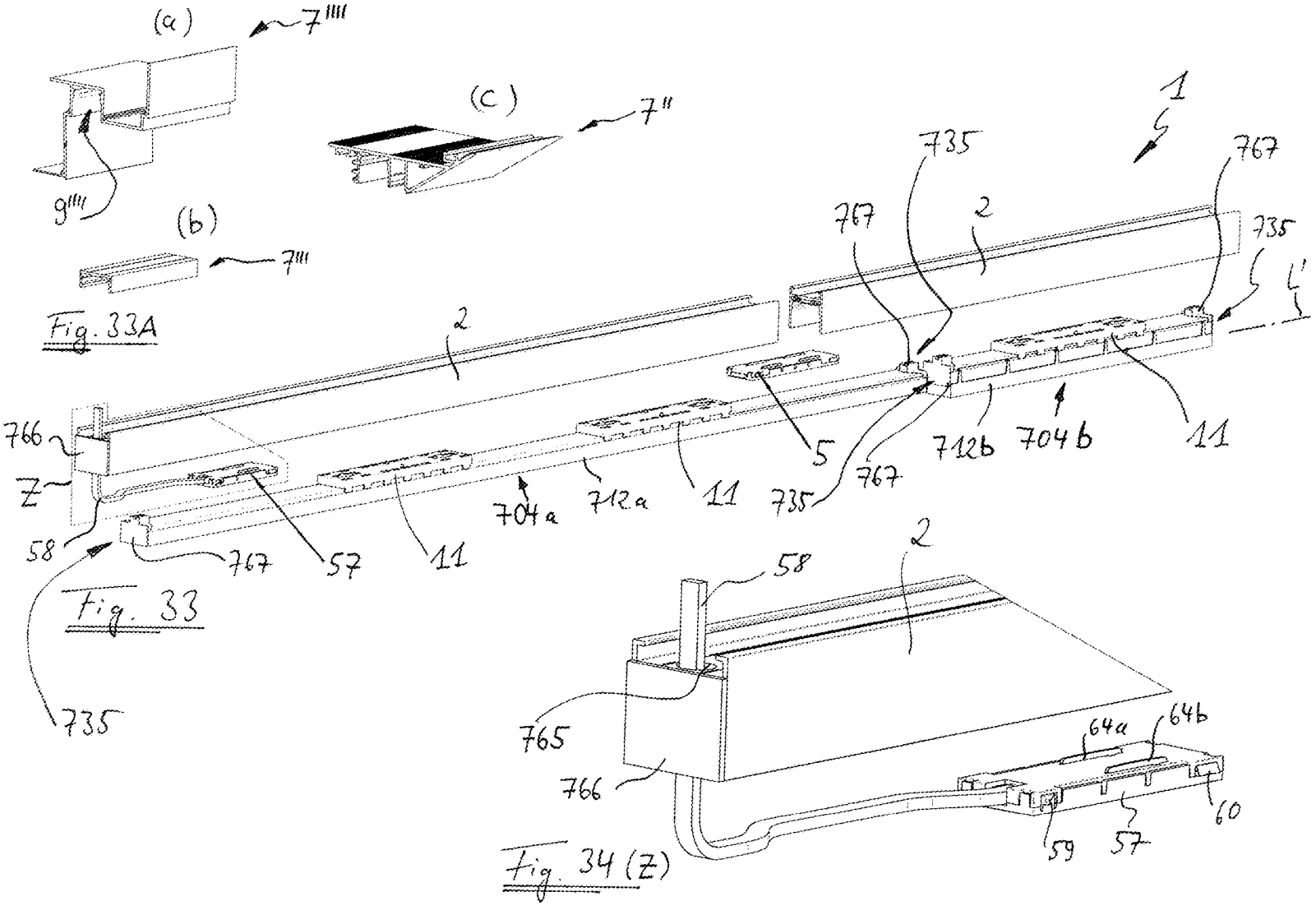
FIG. 33 is a perspective, exploded view of a lighting system according to an eighth embodiment.
FIG. 33A shows variants of a channel for the lighting system according to FIG. 33.
FIG. 34 shows a detail Z from FIG. 33.

When the lighting system 1 is assembled according to the eighth embodiment, the line 58 is guided out of the channel 3 through a passage 765 in the portion 2 of the channel 3 in order to connect the line 58 to a current source, such as a converter. In FIGS. 33 and 34, the passage 765 is designed as a through-bore in the portion 2 of the channel 3, close to an end-face end of the portion 2. For this purpose, the passage 765 is made in the profile body 7 as a bore. In order to make it possible to access the passage 765, the busbar portion 8 may be slightly shorter than the portion 2 of the channel 3, such that the busbar portion 8 does not obscure the passage 765.

In FIG. 33, ends of the channel 3 that are at the end faces in the longitudinal direction are each closed by an end cover 766 that is substantially rectangular in the example in FIG. 33, as a result of which a sealed lighting system is provided.

For the lighting system 1 according to the eighth embodiment, two light units 704*a*, 704*b* are shown in FIG. 33, for example. The light unit 704*a* is designed such that it sits substantially flush in the opening 35' in the channel 3, while the light unit 704*b* protrudes out of the opening 35' (see FIG. 36).

Furthermore, FIGS. 33 and 35 in particular show how, in the region of ends of the light provision and optics unit 712*a* and 712*b* that are at the end faces thereof in the longitudinal direction L', end faces 735 of the light units 704*a-b* may each end in an end cap 767. In the case of a junction point 6 directly over the connector 5, at this location end caps 767 may optionally be omitted or suitably adjusted in terms of their height.

Some profile bodies 7'''', 7''', 7'' that may be used for the portions 2 of the channel 3 in a lighting system 1 according to the eighth embodiment are shown, by way of example, in FIG. 33A in partial images (a), (b) and (c).

In particular in the case of light units 104, 204, 304 and 604, the housing component 121, 221, 321 and 621, respectively, is not necessarily transparent, but may rather be opaque. A housing component that is either transparent or opaque is conceivable even in the light units 404, 504 and 704*a, b*.

It is noted that the light units 4, 104, 104*a-b*, 204, 304, 404, 504, 604, 704*a-b* described above in relation to the embodiments may be used in combination in one of the channels 3 described above and also in lengths that are selected depending on the requirement and the channel length. This provides a wide range of possibilities for combination. Furthermore, the light units 4, 104, 104*a-b*, 204, 304, 404, 504, 604, 704*a-b* can each be inserted into channels 3 having different profile bodies 7, 7', 7'', 7''', 7''''.

By wirelessly switching and/or controlling the light output of the light units 4, 104, 104*a-b*, 204, 304, 404, 504, 604, 704*a-b*, as provided in all of the above-described embodiments, simple operation of the lighting system and a particularly space-saving, slim structure are achieved.

The lenses 26, 126, 226, 326, 626 described above in relation to the embodiments allow for a shallow optical system, in particular in the depth direction T, and therefore contribute to a decrease in the space requirement and in particular in the installation depth of the channel 3. Precisely the combination of a shallow power supply unit 11, wireless control of the light units, the slim magnetic attachment solution for the light units, and the shallow connector 5 advantageously allows space and installation depth to be economised, while still allowing for highly aesthetic lighting solutions.

As the power supply unit 11 has the same structure in all the above-described embodiments, the structure of the lighting system can be simplified, and costs can be reduced, by standardising components. However, for different light units 4, 104, 104*a-b*, 204, 304, 404, 504, 604, 704, the circuit board 37 may, if necessary or desired, be designed and/or populated in a manner suitable for the particular light unit, or may rather always be designed identically.

The magnetic attachment solution by means of permanent magnets 42 and the steel core 50 allows for fast, simple and reliable attachment of the light units 4 to 704 and low overall dimensions in all the above-described embodiments.

In all the above-described embodiments, light units having lengths L4 of approximately L4=300 mm or approximately L4=600 mm or L4=1,200 mm or L4=1,800 mm or L4=2,400 mm, for example, may be provided, it being possible to assemble strip lights from a combination of light units 4 having different and/or the same lengths and a corresponding number of connectors 5. While short light units 4 can manage with one power supply unit 11, longer light units 4 may be provided with two or more power supply units 11. The above observations concerning L4 apply, accordingly, to the lengths L104, L204, L304, L604 of the light units 104, 204, 304, 604, respectively, and to the lengths of the light units 404, 504, 704*a-b*. Lengths other than those mentioned above are also conceivable, for example approximately L604=500 mm.

If a strip light having a given, desired total length cannot be produced merely by combining light units 4-704 of several of the provided lengths, e.g. L4, L104, L204, L304, L604, it is possible, in any of the above-described embodiments, to better adjust the light units to the desired length by shortening the light provision and optics unit. For this purpose, the LED circuit board 24 can be cut at regular intervals.

For the above embodiments, the connector 5 is designed as a linear connector for coupling busbar portions 8 that are associated with straight portions 2 of the channel 3 that follow one another in a straight line. However, in a variant (not shown in the drawings), the connector 5 may be designed to electrically couple busbar portions 8 that are associated with straight portions 2 which follow one another in an angular manner.

In the lighting systems according to all the above-described embodiments, the channel 3 may, over shorter or longer sub-portions in the longitudinal direction thereof, not be fitted with the above-described light units 4, 104, 104*a-b*, 204, 304, 404, 504, 604 and/or 704*a-b*, but rather one or more additional lighting inserts of different types may be inserted into the channel 3. In this case, sub-portions of the channel 3 may even be left empty. The additional lighting inserts may be lighting inserts which, in the same way as the above-described light units 4, 104, 104*a-b*, 204, 304, 404, 504, 604 and/or 704*a-b*, are supplied with current via the busbar 10 and of which the light output can be switched and/or controlled wirelessly, e.g. by means of a Zigbee. However, it may be that one or more of the additional lighting inserts is not designed to overlap the connector 5. The additional light units may be designed, for example, as a spotlight, a pivotable spotlight, a suspended spotlight, a wallwasher, a linear arrangement of spotlights, a linear lighting insert that radiates in a diffused manner, or a pendant light fixture.

Although the present invention was described completely on the basis of various embodiments above, said invention is not limited thereto, but rather may be modified in a variety of ways.

For example, in addition to the magnetic attachment, the light unit could be designed to be additionally snap-fittingly or latchingly connected to the channel in a form-fitting manner.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 10 2016 225 199.6, filed Dec. 15, 2016, are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A lighting system, comprising at least one channel for receiving at least one light unit that can be inserted into the channel, and at least one connector that can be inserted into the channel;

wherein the channel comprises, in an inner region of said channel, a busbar for supplying the light unit, which can be electrically coupled to the busbar, with power;

wherein the connector is designed to electrically couple busbar portions of the busbar to one another, and wherein the connector is designed to be mechanically coupled to portions of the channel; and wherein the channel and the connector are designed such that, when inserted in the channel, the light unit can be arranged so as to overlap the connector, inserted into the channel in order to couple the busbar portions, within the channel.

2. The lighting system according to claim 1 further comprising the at least one light unit, wherein the channel, the light unit and the connector are designed such that the light unit can be received completely in the channel when inserted and overlapping the connector.

3. The lighting system according to claim 1, wherein the light unit and the channel are designed such that, when inserted, the light unit is arranged in the opening in the channel so as to be flush therewith, or that, when inserted, the light unit is offset in the inner region of the channel in relation to the opening in the channel.

4. The lighting system according to claim 1 further comprising the at least one light unit, wherein the channel, the light unit and the connector are designed such that the light unit protrudes out of the opening in the channel when inserted and overlapping the connector.

5. The lighting system according to claim 1, wherein the channel and the light unit are designed such that, when inserted, the light unit substantially fills the channel in the transverse direction thereof, at least on a viewing side of said light unit.

6. The lighting system according to claim 1 further comprising at least two of the light units, which can be each arranged so as to overlap the connector within the channel such that end portions of the light units that overlap the connector substantially directly adjoin one another on the end faces thereof.

7. The lighting system according to claim 1, wherein the light unit is designed as a linearly elongate unit, and wherein the light unit is designed to form, together with at least one further linearly elongate light unit and when inserted in the channel, a continuous strip light during operation; or wherein light can be emitted, during operation, by the light unit in a light outlet region that extends over substantially the entire length of the light unit.

8. The lighting system according to claim 1, wherein the light unit can be coupled to the channel in order to hold said light unit, in particular can be magnetically coupled to the channel.

9. The lighting system according to claim 1, wherein the light unit comprises a light provision and optics unit and at least one power supply unit, the power supply unit comprising contact devices, which allow the light unit to be electrically coupled to the busbar, the power supply unit being electrically coupled to the light provision and optics unit, and the power supply unit further comprising a housing element that is mechanically coupled to the light provision and optics unit.

10. The lighting system according to claim 9, wherein the power supply unit is latched to the light provision and optics unit.

11. The lighting system according to claim 9, wherein the housing element of the power supply unit projects, in a direction which extends in parallel with a depth direction of the channel when the light unit is inserted, substantially as far beyond the light provision and optics unit as a housing of the connector extends in a thickness direction of the connector.

12. The lighting system according to claim 9, wherein the light unit can be switched or controlled wirelessly, and wherein the power supply unit comprises a module by which control signals for switching or controlling the light output of the light provision and optics unit can be received wirelessly.

13. The lighting system according to claim 9, wherein the power supply unit is designed as a holding unit for the light unit, for holding said light unit in the channel.

14. The lighting system according to claim 13, wherein the power supply unit contains magnets for mechanically coupling the light unit to the channel.

15. The lighting system according to claim 9, wherein, in a direction which extends transversely to a depth direction of the channel when the light unit is inserted, a width of the power supply unit is at least 80 percent, of a width of the light provision and optics unit; or wherein in a direction which extends in parallel with a depth direction of the channel when the light unit is inserted, the light provision and optics unit has a height of from approximately 13 mm to approximately 20 mm, or wherein in a direction which extends transversely to a depth direction of the channel when the light unit is inserted, the light provision and optics unit has a width of from approximately 24 mm to approximately 28 mm, or wherein the channel comprises, at least in a region in which the light provision and optics unit is housed when the light unit is inserted, an inner width of from approximately 27.5 mm to approximately 28.5 mm.

16. The lighting system according to claim 1, wherein, in a direction which extends in parallel with a depth direction of the channel when the light unit is inserted, the light unit has a height, as measured over housing parts of the light unit, of from approximately 19 mm to approximately 27 mm, or wherein the channel has a depth, available for receiving the light unit, of from approximately 19 mm to approximately 22 mm.

17. The lighting system according to claim 1, wherein the light unit comprises a linearly elongate lens.

18. The lighting system according to claim 17, wherein the light provision and optics unit comprises a housing component in which the lens and an LED circuit board are housed, the housing component of the light provision and optics unit being mechanically coupled to the housing element of the power supply unit.

19. The lighting system according to claim 17, wherein the lens has a cross section which is substantially constant in a longitudinal direction of the lens, and in particular in that, in a direction which is in parallel with a depth direction of the channel when the light unit is inserted, the extension of the lens is smaller than in a width direction of the lens transverse to the depth direction of the channel.

20. The lighting system according to claim 1, wherein the connector comprises movable catches, and the channel is provided, in the inner region, with longitudinal ribs, the catches being designed to engage behind the longitudinal ribs in order to latchingly couple the connector to the portions of the channel, and it being further possible for an operator to disengage the catches from the longitudinal ribs, in order to release the coupling, by actuating an actuation element or a plurality of actuation elements.

* * * * *